US006898391B2

(12) United States Patent
Numagami et al.

(10) Patent No.: US 6,898,391 B2
(45) Date of Patent: May 24, 2005

(54) PROCESS CARTRIDGE, ELECTRIC CONTACT AND ELECTROPHOTOGRAPHIC IMAGE FORMING APPARATUS

(75) Inventors: Atsushi Numagami, Hadano (JP); Kazunari Murayama, Shizuoka-ken (JP); Shigeru Hoashi, Numazu (JP); Takahito Ueno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/012,386

(22) Filed: Dec. 12, 2001

(65) Prior Publication Data

US 2002/0085854 A1 Jul. 4, 2002

(30) Foreign Application Priority Data

Dec. 13, 2000 (JP) ..... 2000/378501
Nov. 19, 2001 (JP) ..... 2001/353129

(51) Int. Cl.[7] ..... G03G 15/00; G03G 21/18
(52) U.S. Cl. ..... 399/90; 399/111
(58) Field of Search ..... 399/90, 111, 112

(56) References Cited

U.S. PATENT DOCUMENTS 5,477,306 A * 12/1995 Iguchi et al. ..... 347/130
5,500,714 A 3/1996 Yashiro et al.
5,543,898 A 8/1996 Shishido et al.
5,617,579 A 4/1997 Yashiro et al.
5,689,774 A 11/1997 Shishido et al.
5,768,658 A 6/1998 Watanabe et al.
5,920,753 A 7/1999 Sasaki et al.
5,937,239 A 8/1999 Watanabe et al.
5,966,566 A 10/1999 Odagawa et al.
5,966,568 A 10/1999 Numagami et al.
6,006,058 A 12/1999 Watanabe et al.
6,016,413 A 1/2000 Yokoyama et al.
6,029,032 A 2/2000 Watanabe et al.
6,097,908 A 8/2000 Uchiyama et al.
6,097,909 A 8/2000 Watanabe et al.

(Continued)

FOREIGN PATENT DOCUMENTS

JP 63004253 A * 1/1988
JP 10-301465 11/1998
JP 2000-181166 6/2000

OTHER PUBLICATIONS

English Abstract of Japanese Patent Document No. 2000–181166.
English Abstract of Japanese Patent Document No. 10–301465.

*Primary Examiner*—William J. Royer
(74) *Attorney, Agent, or Firm*—Fitzpatrick, Cella, Harper & Scinto

(57) ABSTRACT

An electrical contact member is usable with a process cartridge, and is for establishing an electrical connection between the process cartridge and a main assembly of an electrophotographic image forming apparatus, when the process cartridge is mounted to the main assembly of the apparatus. The process cartridge includes an electrophotographic photosensitive drum and a process device actable on the photosensitive drum. The electrical contact member includes: a base member; a mounting portion for mounting the base member to a frame of the process cartridge; a positioning portion for positioning the base member in the frame when the base member is mounted to the frame of the process cartridge by the mounting portion; and an electrical contact portion, projected from the base member, for establishing an electrical connection with a main assembly side electrical contact member, which is provided in the main assembly of the apparatus, by pressing in a direction against the main assembly side electrical contact member when the process cartridge is mounted to the main assembly of apparatus. This direction is different from a mounting direction in which the process cartridge is mounted to the main assembly of the apparatus.

42 Claims, 12 Drawing Sheets

U.S. PATENT DOCUMENTS 6,169,866 B1 1/2001 Watanabe et al.
6,246,849 B1 6/2001 Yokoyama et al.
6,266,503 B1 7/2001 Murayama et al.
6,272,299 B1 8/2001 Numagami et al.
6,289,189 B1 9/2001 Numagami et al.
6,330,409 B1 12/2001 Watanabe et al.

* cited by examiner

PROCESS CARTRIDGE, ELECTRIC CONTACT AND ELECTROPHOTOGRAPHIC IMAGE FORMING APPARATUS

FIELD OF THE INVENTION AND RELATED ART

The present invention relates to a process cartridge removably mountable in the main assembly of an electrophotographic image forming apparatus, electrical contacts therefor, and an electrophotographic image forming apparatus.

An electrophotographic image forming apparatus means an apparatus for forming an image on recording medium, with the use of an electrophotographic image formation process. The examples of an electrophotographic image forming apparatus include electrophotographic copying machines, electrophotographic printers (LED printers, laser beam printers, and the like), facsimile apparatuses, word processors, and the like.

A process cartridge means a cartridge, that is, a shell, in which a charging means, a developing means or a cleaning means, and an electrophotographic photoconductive drum as an image bearing member, are integrally placed, and which is removably mountable in the main assembly of an electrophotographic image forming apparatus. It also means a cartridge in which an electrophotographic photoconductive drum, and a minimum of one means among a charging means, a developing means, and a cleaning means, are integrally placed, and which is removably mountable in the main assembly of an electrophotographic image forming apparatus, and a cartridge, in which a minimum of a developing means and an electrophotographic image forming apparatus are integrally placed, and which is removably mountable in the main assembly of an electrophotographic image forming apparatus.

A developing apparatus means a cartridge in which a developer storage portion and a developing means are integrally placed, and which is removably mountable in the main assembly of an image forming apparatus.

An electrophotographic image forming apparatus employing an electrophotographic image formation process also employs a process cartridge system, in which an electrophotographic photoconductive member, and a single or a plurality of processing means which act on the electrophotographic photoconductive member, are integrally placed, and which is removably mountable in the main assembly of an electrophotographic image forming apparatus. Employment of a process cartridge system has significantly improved the operability of an electrophotographic image forming apparatus, and also, has made it possible for a user to easily maintain the aforementioned processing means. Thus, a process cartridge system is widely in use in the field of an electrophotographic image forming apparatus.

SUMMARY OF THE INVENTION

Referring to FIGS. 12 and 13, the embodiments of the present invention, which were developed during the course of the development of the present invention, will be described. Incidentally, these embodiments have not been made public.

In order to make processing means (for example, development roller, charge roller, or charging process facilitation brush) within a cartridge 1, which is removably mountable in the main assembly of an electrophotographic image forming apparatus (which hereinafter will be referred to as apparatus main assembly (FIG. 1)), function, high voltage is necessary. Such high voltage is supplied to the cartridge 1 from the apparatus main assembly 100. Referring to FIG. 12, the surface of the leading end (front side in FIG. 12) of the cartridge 1, in terms of the direction in which the cartridge 1 is inserted into the apparatus main assembly 100, is provided with a contact 70. Referring to FIG. 13, the apparatus main assembly 100 is provided with a contact pin 95, which is kept pressed upon the contact 70 of the cartridge 1 by a contact spring 96 of the apparatus main assembly 100, in order to supply the processing means with voltage.

In order to ensure that the electrical contact between the apparatus main assembly 100 and cartridge 1 is maintained, the contact spring 96 needs to generate a contact pressure of several hundreds of gf (200 gf–500 gf). Further, when a plurality of processing means are contained in the cartridge 1, the contact 70 and contact pin 95 are needed by the count equal to that of the processing means. Thus, the sum of the contact pressures from all the contact springs 96 reaches the order of hundred ksf, reaching sometime several hundreds of ksf.

In order to simplify the process through which each contact pin 95 and the corresponding contact 70 are placed in contact with each other, the apparatus main assembly 100 and cartridge 1 are structured so that the contact pins 95 and contacts 70 are placed in contact with each other, by the movement of the process cartridge 1 made as the process cartridge 1 is mounted into the apparatus main assembly 100. Therefore, a contact pressure A acts upon the cartridge 1 in the direction counter to the direction D in which the cartridge 1 is mounted into the apparatus main assembly 100 (FIG. 13).

In a case that the contact pressure A, which is the contact pressure between a single contact and the corresponding contact pin, or the sum of the contact pressures between a plurality of contacts and a plurality of corresponding contact pins, acts in the direction counter to the cartridge mounting direction D, the cartridge 1 is subjected by the contact pressure A, to a substantial amount of pressure that acts in the direction to push the cartridge 1 out of the apparatus main assembly 100.

Therefore, in order to retain the cartridge 1 in a predetermined position within the apparatus main assembly 100, it is necessary to apply to the cartridge 1, such pressure that is large enough to cancel the substantial amount of contact pressure A applied to the cartridge 1 by the contact pin or pins. As for the member for holding the cartridge 1 from the opposite of the cartridge 1 with respect to the side to which the contact pressure A applies, it is possible use a lid 59 for covering the opening 100*a*, with which the apparatus main assembly 100 is provided to allow the cartridge 1 to be inserted into the apparatus main assembly 100.

When the process cartridge 1 is mounted into, or dismounted from, the apparatus main assembly 100, the lid 59 is placed in the position in which the opening 100*a*, with which the apparatus main assembly 100 is provided to insert the process cartridge 1 into the apparatus main assembly, is exposed. The lid 59 is structured so that it can be moved to expose or cover the opening 100*a*.

In order for the lid 59 to be able to cancel the aforementioned pressure A, the lid 59 itself must be given strength higher than a certain level, and also, the rotational axle 305, about which the lid 59 is rotated to be opened or closed, must be given strength higher than a certain level. Further, in order for a user to open or close the lid 59, the user must have strength sufficient to overcome the pressure A.

Referring to FIG. 1, in a case that the apparatus main assembly 100 is the apparatus main assembly of a color copying machine, it is equipped with a plurality of process cartridges 1Y, 1M, 1C, and 1K, the number of which matches the number of toners used by the apparatus. Referring to FIG. 6, when only a single lid 59 is used as the common lid for mounting or dismounting all the process cartridges, in other words, the mechanism related to the exposing or covering the opening 100*a* has been simplified, the lid 59 is relatively large, and is subjected to the sum of the all the contact pressures A generated by all the contacts 70 of all process cartridges and the corresponding contact pins 95. Therefore, the lid 59 for such an apparatus must be further increased in strength, compared to the lid of a monochromatic image forming apparatus.

The present invention was made to solve the above described problem.

The primary object of the present invention is to provide a combination of a process cartridge which is easy to mount into the apparatus main assembly of an electrophotographic image forming apparatus, and an electrophotographic image forming apparatus, which is compatible with such a process cartridge.

Another object of the present invention is to provide a combination of a process cartridge, electrical contacts, and an electrophotographic image forming apparatus, which is substantially smaller, compared to a conventional combination, in the load generated by the electrical contacts of the apparatus main assembly when the process cartridge is mounted into the apparatus main assembly.

Another object of the present invention is to provide a combination of a process cartridge, electrical contacts, and an electrophotographic image forming apparatus, which ensures that electrical connection is established and maintained between the process cartridge and the apparatus main assembly when the process cartridge is mounted into the apparatus main assembly.

Another object of the present invention is to provide a combination of a process cartridge, electrical contacts, and an electrophotographic image forming apparatus, which is substantially smaller, compared to a conventional combination, in the load to which the process cartridge is subjected when electrical connection is established and maintained between the electrical contacts of the process cartridge and the electrical contacts of the apparatus main assembly as the process cartridge is mounted into the apparatus main assembly.

Another object of the present invention is to provide: an electrical contact which establishes and maintains electrical connection between itself and the electrical contact, with which the main assembly of an image forming apparatus is provided, by pressing on the electrical contact of the apparatus main assembly in such a direction that is different from the direction in which the process cartridge is mounted into the apparatus main assembly; a process cartridge having such an electrical contact; and an electrophotographic image forming apparatus in which such a process cartridge is removably mountable.

According to an aspect of the present invention, there is provided an electrical contact member, usable with a process cartridge, for establishing electrical connection between the process cartridge and a main assembly of an electrophotographic image forming apparatus, when the process cartridge is mounted to the main assembly of the apparatus, the process cartridge including an electrophotographic photosensitive drum and process means actable on the photosensitive drum, said electrical contact member comprising a base member; a mounting portion for mounting said base member to a frame of the process cartridge; a positioning portion for positioning said base member in said frame when said base member is mounted to the frame of said process cartridge by said mounting portion; an electrical contact portion, projected from the base member, for establishing electrical connection with a main assembly side electrical contact member, which is provided in the main assembly of the apparatus, by pressing in a direction against the main assembly side electrical contact member when the process cartridge is mounted to the main assembly of apparatus, wherein said direction is different from a mounting direction in which the process cartridge is mounted to the main assembly of the apparatus.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, an electrophotographic color image forming apparatus in accordance with the present invention will be described with reference to the appended drawings In the following description of the present invention, the lengthwise direction means the direction parallel to the axial line of the electrophotographic photoconductive drum (which hereinafter will be referred to as photoconductive drum). Further, the side of a process cartridge or the apparatus main assembly, toward which the process cartridge is inserted, is referred to as rear side, and the side of the process cartridge or the apparatus main assembly, toward which the process cartridge is pulled out, is referred to as the front side. The top or bottom side of the process cartridge means the top or bottom side of the process cartridge when the process cartridge is in its proper position in the apparatus main assembly.

[Description of the General Structure of Image Forming Apparatus Main Assembly]

Figure 1:
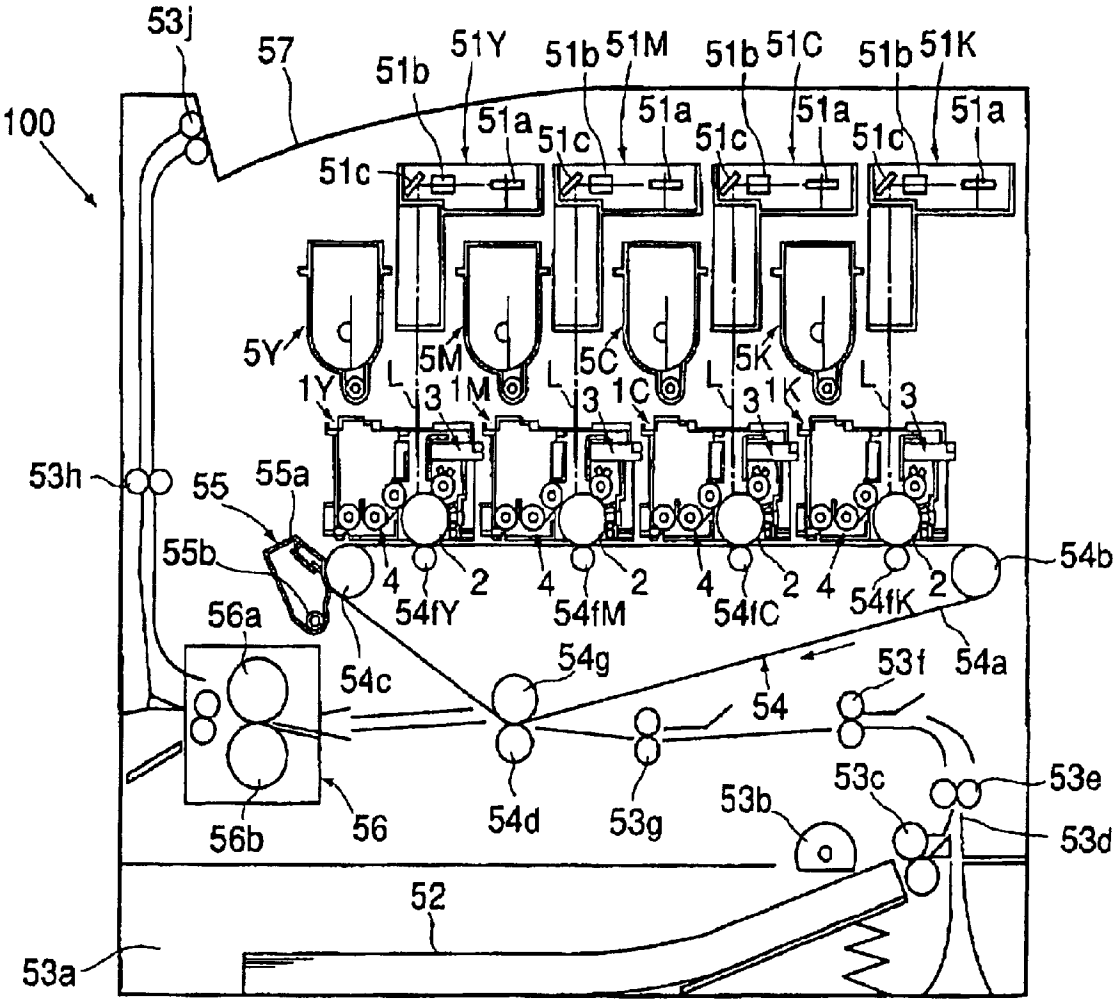
FIG. 1 is a vertical sectional view of the main assembly of an electrophotographic color image forming apparatus in accordance with the present invention.

First, referring to FIG. 1, the general structure of an electrophotographic color image forming apparatus will be roughly described. FIG. 1 shows the general structure of a color laser beam printer, which is one of the various forms of an electrophotographic color image forming apparatus.

The image formation station of this printer is provided with four process cartridges 1Y (which contains toner of yellow color), 1M (which contains toner of magenta color), 1C (which contains toner of cyan color), and 1K (which contains toner of black color), each of which is equipped with a photoconductive drum 2. It is also provided with four exposing means (laser beam based optical scanning systems) 51Y, 51M, 51C, and 51K, which are disposed above the corresponding four process cartridges, in parallel to each other.

Below the aforementioned image formation stations a feeding/conveying portion for sending a recording medium 52 to the image forming station, an intermediary transfer belt 54*a*, onto which a toner image formed on the photoconductive drum 2 is transferred, a secondary transfer roller 54*d* for transferring the toner image on the intermediary transfer belt 54*a* onto the recording medium 52, are disposed.

In addition, a fixing means for fixing the unfixed toner image on the recording medium 52 to the recording medium 52, and a discharging means for discharging the recording medium 52 out of the apparatus main assembly and placing it on the preceding recording medium 52, are disposed below the image formation station. At this time, the structure of each of the above described portions of the image forming apparatus will be described in detail in the logical order.

[Feeding/Conveying Portion]

The feeding/conveying portion is a portion for feeding the recording medium 52 to the image formation station. It comprises a feeder cassette 53*a*, in which a plurality of recording media 52 are stored in layers, a feeder roller 53*b*, a retarding roller 53*c* for preventing two or more recording media 52 from being fed at the same time, a recording medium guide 53*d*, and a registration roller 53*g*.

The feeder roller 53*b* rotates in synchronism with an image forming operation, and feeds the recording media 52 into the apparatus main assembly, one by one, out of the cassette 53*a*. The recording media 52 are prevented by the retarding roller 53*c* from being conveyed in layers. Each recording medium 52 is conveyed to the registration roller 53*g*, past conveyer rollers 53*e* and 53*f*, being guided by the recording medium guide 53*d*.

The moment the recording medium 52, which is being conveyed to the registration roller 53*g*, comes into contact with the registration roller 53*g*, the registration roller 53*g* is not being rotated. Thus, if the recording medium 52 is skewed, it is straightened as it comes into contact with the registration roller 53*g*.

During an image forming operation, the registration roller 53*g* repeats a predetermined sequence consisting of a non-rotational state in which it keeps the recording medium 52 on standby, and a rotational state in which it conveys the recording medium 52 toward the transfer belt 54*a*; in other words, the registration roller 53*g* controls the conveyance of the recording medium 52 so that a toner image and the recording medium 52 align with each other during the transfer process.

[Process Cartridge]

The process cartridges 1Y, 1M, 1C, and 1K each comprise a photoconductive drum 2, a charging means, and a developing means, which are integrally disposed in a shell, that is, cartridge, in such a manner that the charging means and developing means are located close to the peripheral surface of the photoconductive drum 2. The process cartridge 1 can be easily removed by a user from the main assembly (which hereinafter will be referred to as apparatus main assembly 100) of an electrophotographic image forming apparatus. The process cartridge 1 is replaced as the service life of the photoconductive drum 2 expires. In this embodiment, the number of the rotations of the photoconductive drum 2 is counted, and as the number of the rotations exceeds a predetermined value, it is indicated that the service life of the process cartridge 1 has expired.

The photoconductive drum 2 in this embodiment is an organic photoconductive member, which is charged to the negative polarity. It comprises a hollow aluminum drum 2*h* an a base member, which is approximately 30 mm in diameter, an ordinary photoconductive layer covering the peripheral surface of the base member 2*h*, and a charge injection layer as the outermost layer, which is covering the photoconductive layer. The photoconductive drum 2 is rotationally driven at a predetermined process speed, which in this embodiment is approximately 117 mm/sec.

Figure 4:
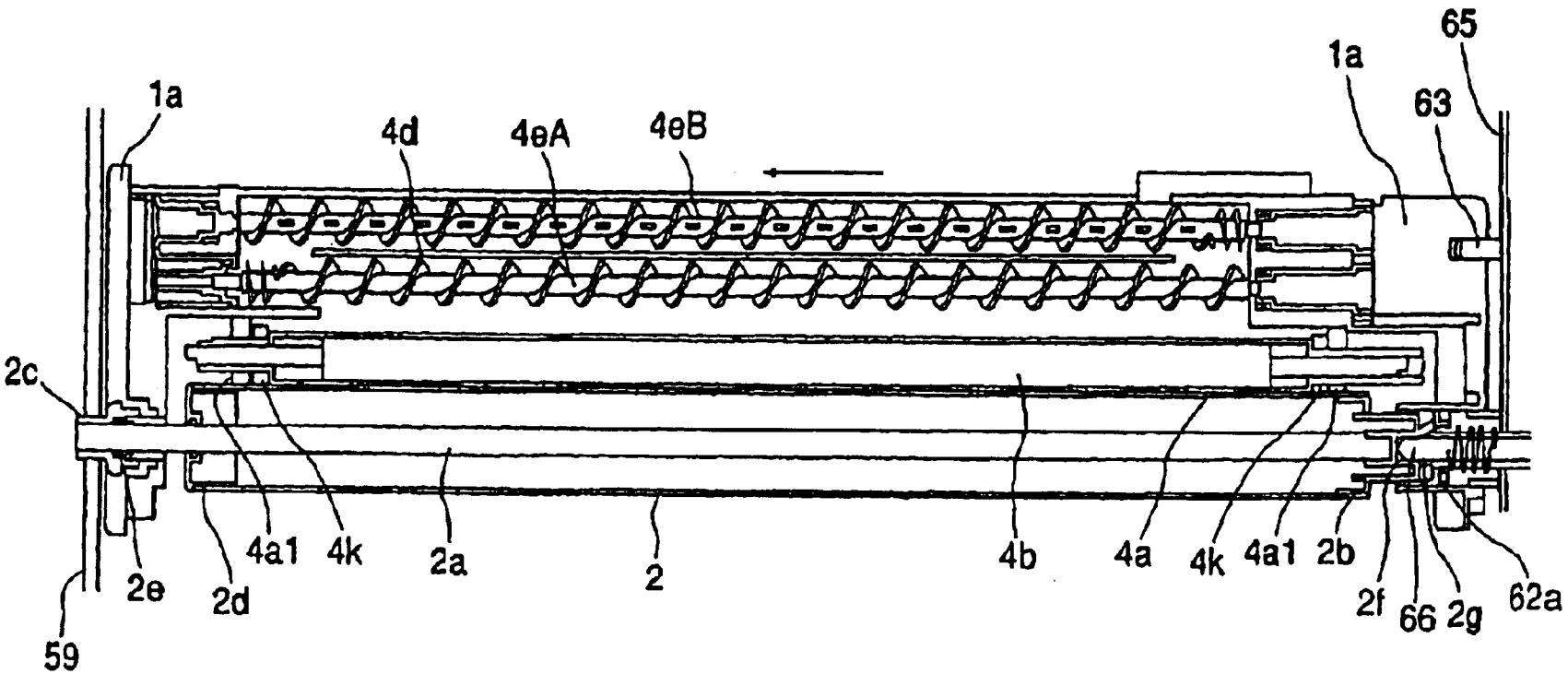
FIG. 4 is a sectional view of the process cartridge in accordance with the present invention, at a plane parallel to the lengthwise direction of the process cartridge.

Referring to FIG. 4, the photoconductive drum 2 is provided with a drum flange 2*b* and a non-driven flange 2*d*, which are fixed to the rear and front ends (right and left end in FIG. 4), respectively, of the photoconductive drum 2 in terms of the lengthwise direction. The photoconductive drum 2 is also provided with a drum shaft 2*a*, which is put through the flanges 2*b* and 2*d* in such a manner that the axial line of the drum shaft 2*a* coincides with the axial lines of the flanges 2*b* and 2*d*. The drum shaft 2*a* and flange 2*d* are engaged with each other so that they integrally rotate. The base member 2*h*, drum shaft 2*a*, and flange 2*b*, integrally rotate. In other words, the photoconductive drum 2 rotates about the axial line of the drum shaft 2*a*.

The front end of the shaft 2*a* is rotationally supported by a bearing 2*e*, which is fixed to a bearing case 2*c*, which is fixed to the frame 1*a* of the cartridge 1.

[Charging Means]

Figure 2:
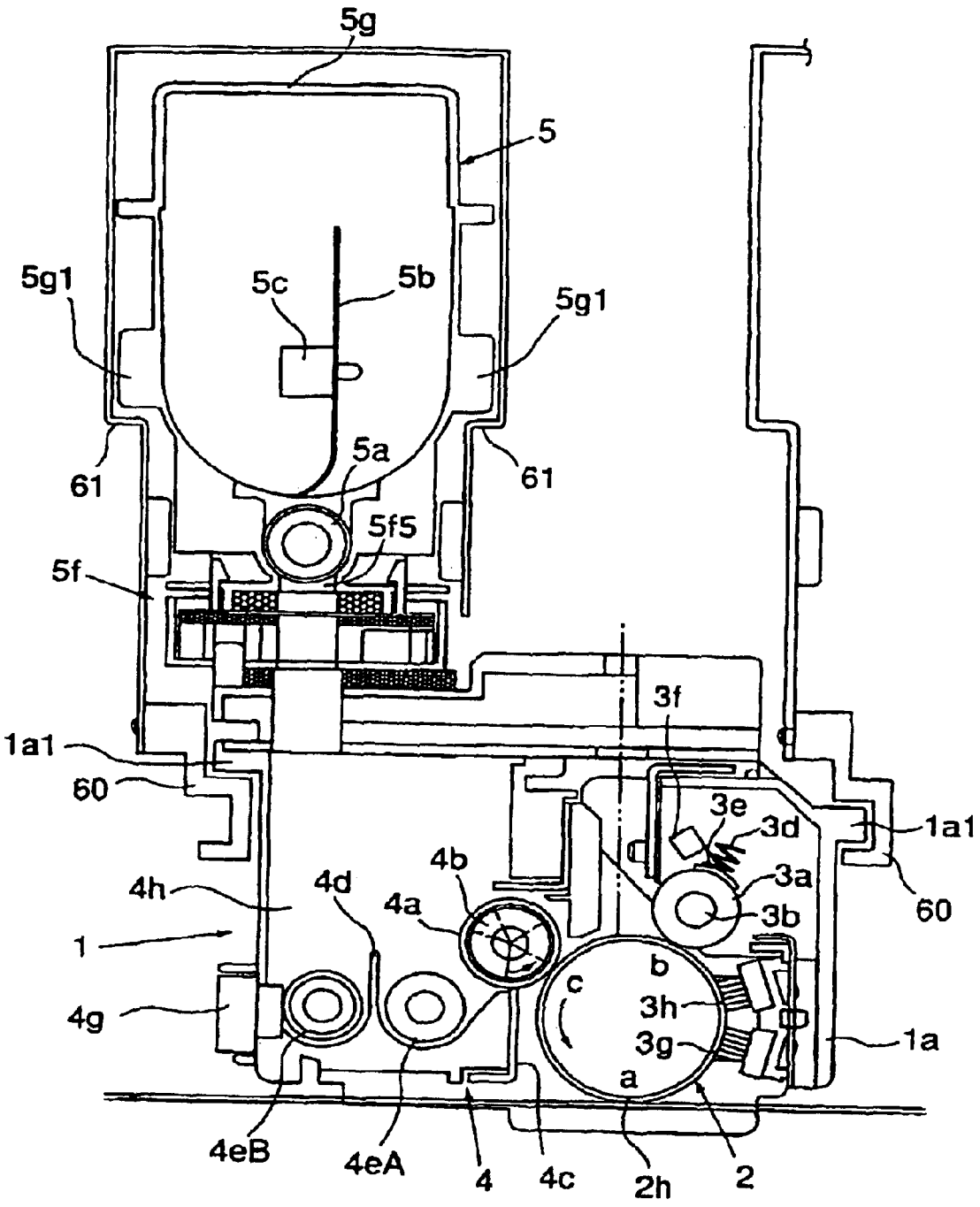
FIG. 2 is a vertical sectional view of a combination of a process cartridge and a toner supply container in accordance with the present invention.

The charging means is such a charging means that employs a contact charging method. Referring to FIG. 2, in this embodiment, a charge roller 3*a* is used as a charging member. The ends of the metallic core 3*b* of the charging roller 3*a* are rotationally supported, one for one, by bearings (unshown). Further, the bearing member is kept pressed by a compression coil spring 3*d* toward the axial line of the photoconductive drum 2. Consequently, the charge roller 3*a* is kept pressed upon the peripheral surface of the photoconductive drum 2, generating a predetermined amount of contact pressure. The charge roller 3*a* is rotated by the rotation of the photoconductive drum 2.

Designated by a referential code 3*e* is a member for cleaning the charge roller 3*a*. In this embodiment, the charge roller cleaning member 3*e* comprises a supporting member 3*f*, and a flexible cleaning film 3*e* attached to the supporting member 3*f*. In length, the flexible film 3*e* virtually matches the charge roller 3*a*, and extends in a direction parallel to the lengthwise direction of the charge roller 3*a*. More specifically, the supporting member 3*f* is enabled to oscillate within a certain range in terms of the lengthwise direction, and the flexible film 3*e* is attached to the supporting member 3*f*, by one of its long edges. The surface of the film 3*e* adjacent to the free long edge of the film 3*e* forms a contact nip against the charge roller 3*a*. As the supporting member 3*f* is oscillated by a driving means (unshown) in the lengthwise direction, the peripheral surface of the charge roller 3*a* is rubbed by the film 3*e*. Consequently, the deposits (microscopic toner particles, external additives, and the like) adhering to the peripheral surface of the charge roller 3*a* are removed.

In this embodiment, a residual toner particle (residual developer image) redistributing means 3*g* for evenly redistributing across the peripheral surface of the photoconductive drum 2, the transfer residual toner particles on the photoconductive drum 2, that is, the toner particles remaining on the peripheral surface of the photoconductive drum 2 after the primary image transfer, is provided on the downstream side in terms of the rotational direction of the photoconductive drum 2, with respect to the transfer station a. Further, on the downstream side in terms of the rotational direction of the photoconductive drum 2, with respect to the residual toner particle redistributing means 3*g*, and on the upstream side in terms of the rotational direction of the photoconductive drum 2, with respect to the charging station b, a toner (developer) charge controlling means 3*h* (auxiliary charging brush) is provided, which is for making all the residual toner particles uniform in polarity, being charged to the normal polarity, or the negative polarity.

With the provision of the residual toner particle redistributing means 3*g*, even if a significant amount of toner particles are left on the peripheral surface of the photoconductive drum 2 after the primary image transfer, they are evenly redistributed across the peripheral surface of the photoconductive drum 2 as they are conveyed from the transfer station a to the charge controlling means 3*h*. Therefore, it does not occur that the residual toner particles concentrate to certain portions of the charge controlling means 3*h*. Therefore, all the residual toner particles are satisfactorily charged by the charge controlling means 3*h* to the normal polarity, being thereby effectively prevented from adhering to the charge roller 3*a*.

In this embodiment, the residual toner particle redistributing means 3*g* and toner charge controlling means 3*h* are in the form of a brush, and have a proper level of electrical conductivity. Their brush portions are in contact with the peripheral surface of the photoconductive drum 2.

Further, these means are moved (oscillated) by a single or a plurality of driving force sources (unshown) in the direction parallel to the lengthwise direction of the photoconductive drum 2.

[Exposing Means]

In this embodiment, the photoconductive drum 2 is exposed by a laser based exposing means. More specifically, as image data signals are sent to the laser based exposing means from the apparatus main assembly 100, a beam L of laser light modulated with the image data signals is projected onto the charged peripheral surface of the photoconductive drum 2, in a manner to scan the peripheral surface of the photoconductive drum 2. As a result, an electrostatic latent image in accordance with the image data signals is formed on the peripheral surface of the photoconductive drum 2.

Referring to FIG. 1, the exposing means comprises a laser element (unshown), a polygon mirror 51*a*, a focusing lens 51*b*, and a reflection mirror 51*c*. The laser element is turned on or off by a light emission signal generation device (unshown), with a predetermined timing, in response to the inputted image data signals. The laser beam L emitted from the laser element is reflected by the polygon mirror 51*a* in a manner to produce a scanning movement, and is focused on the peripheral surface of the photoconductive drum 2 through the focusing lens 51*b* and reflection minor 51*c*.

[Developing Apparatus]

The developing apparatus 4 in this embodiment is a contact type developing apparatus which employs two component developer (two component magnetic brush type developing apparatus). Referring to FIG. 2, the developer, which is a mixture of carrier and toner, is borne on the peripheral surface of a development roller 4*a* as a developing means, which contains a magnetic roll 4*b* in its hollow. The developing apparatus 4 is provided with a regulator blade 4*c*, which is disposed adjacent to the peripheral surface of the development roller 4*a*, holding a predetermined gap relative to the peripheral surface of the development roller 4*a*. It forms a thin layer of the developer on the peripheral surface of the development roller 4*a*, as the development roller 4*a* is rotated in the direction indicated by an arrow mark. Incidentally, in this embodiment, a two component magnetic brush type developing apparatus is employed as the developing apparatus However, developing apparatus selection does not need to be limited to the one utilized in this embodiment.

Referring to FIG. 4, the development roller 4*a* is provided with a pair of journal portions 4*a*1, which are attached to the lengthwise ends of the development roller 4*a*, one for one. Each journal portion 4*a*1 is fitted with a spacer ring 4*k*, which is greater in radius, by an amount equal to the development gap, than the development roller 4*a*. The gap between the peripheral surfaces of the development roller 4*a* and photoconductive drum 2, in which a magnetic brush is formed, is created by placing the spacer ring 4*k* in contact with the peripheral surface of the photoconductive drum 2. Referring to FIG. 2, the development roller 4*a* is rotationally driven in the direction indicated by an arrow mark. Consequently, the peripheral surface of the development roller 4*a* moves in the direction counter to the moving direction of the peripheral surface of the photoconductive drum 2, in the development station c.

The developer used in this embodiment is a mixture of toner and carrier. The mixing ratio between the toner and carrier is 6:94 in weight ratio. Developer selection does not need to be limited to the mixture of toner and magnetic carrier. Instead, magnetic toner may be employed.

Referring to FIG. 2, the developer storage portion 4*h* in which the developer is stored has two portions separated by a partitioning wall 4*d*, which extends in the lengthwise direction. The two portions separated by the partitioning wall 4*d* are provided with a pair of stirring screws 4*e*A and 4*e*B, one for one, which are disposed in a manner to sandwich the partitioning wall 4*d*.

Referring to FIG. 4, after being supplied from a toner supply container 5, toner fall onto the rear end of the screw 4*e*B (right end in FIG. 4), and is conveyed in the lengthwise direction toward the front (left end in FIG. 4), while being stirred by screw 4*e*B. At the front end of the developer storage portion 4*h*, the toner is moved into the portion with the screw 4*e*A, past the gap between the front end of the partition wall 4*d* and the front wall of the toner storage portion 4*h*. Then, the toner is sent back to the rear end (right end in FIG. 4) in terms of the lengthwise direction, by the screw 4*e*A. At the rear end, the toner is moved back into the portion with the stirring screw 4*e*B, past the gap between the rear end of the partitioning wall 4*d* and the rear wall of the toner storage portion 4*h*, to be conveyed again by the screw 4*e*B toward the front end while being stirred. In other words, the toner is circulated in the toner storage portion 4*h* as described above.

At this time, referring to FIG. 2, the development process for developing an electrostatic latent image on the photoconductive drum 2, with the use of the developing apparatus 4 along with the two component magnetic brush based developing method, and the developer circulation system, will be described. As the development roller 4*a* is rotated, the developer in the developer storage portion 4*h* is picked wp by the magnetic roll 4*b*, onto the peripheral surface of the development roller 4*a*, and is conveyed.

While being conveyed, the developer layer on the peripheral surface of the development roller 4*a* is regulated in thickness by the regulator blade 4*c* disposed adjacent to the development roller 4*a* in a manner to hold a predetermined gap relative to the peripheral surface of the development roller 4*a*. As a result, a thin layer of the developer with a predetermined thickness is formed on the peripheral surface of the development roller 4*a*. As the portion of the developer on the peripheral surface of the development roller 4*a*, the thickness of which has been regulated, is conveyed to a location corresponding to the development pole of the magnetic roll 4*b*, the location of which corresponds to the location of the development station c, the developer particles are agglomerated in the form of a broom tip by the magnetic force. The electrostatic latent image on the peripheral surface of the photoconductive drum 2 is developed into a toner image by the toner particles in the agglomeration of the developer particles in the form of a broom tip.

The developer particles in the portion of the developer layer on the development roller 4*a*, which has passed the development station c, enter the developer storage portion 4*h* as the development roller 4*a* is further rotated. Entering the developer storage portion, they are made to separate from the peripheral surface of the development roller 4*a*, by the repulsive magnetic field from the conveyance pole, and fall into the developer storage portion 4*h*.

To the development roller 4*a*, a combination of DC voltage and AC voltage is applied from an electric power source (unshown). In this embodiment, a combination of a DC voltage of 500 V, and an AC voltage with a frequency of 2,000 Hz and a peak-to-peak voltage of 1,500 V, is applied to the development roller 4*a*.

As the toner is consumed by development, the toner content (ratio) of the developer reduces. Thus, in this embodiment, a sensor 4*g* for detecting the toner ratio of the developer is provided as shown in FIG. 2; the sensor 4*g* detects the state of the developer, in which the toner ratio is lower than a predetermined level. As the sensor 4*g* detects that the toner ratio of the developer has fallen below the predetermined level, toner is supplied to the toner storage portion 4*h* from the toner supply container 5. The toner ratio of the developer is always kept at a predetermined level by this toner supplying operation.

[Toner Supply Container]

Figure 5:
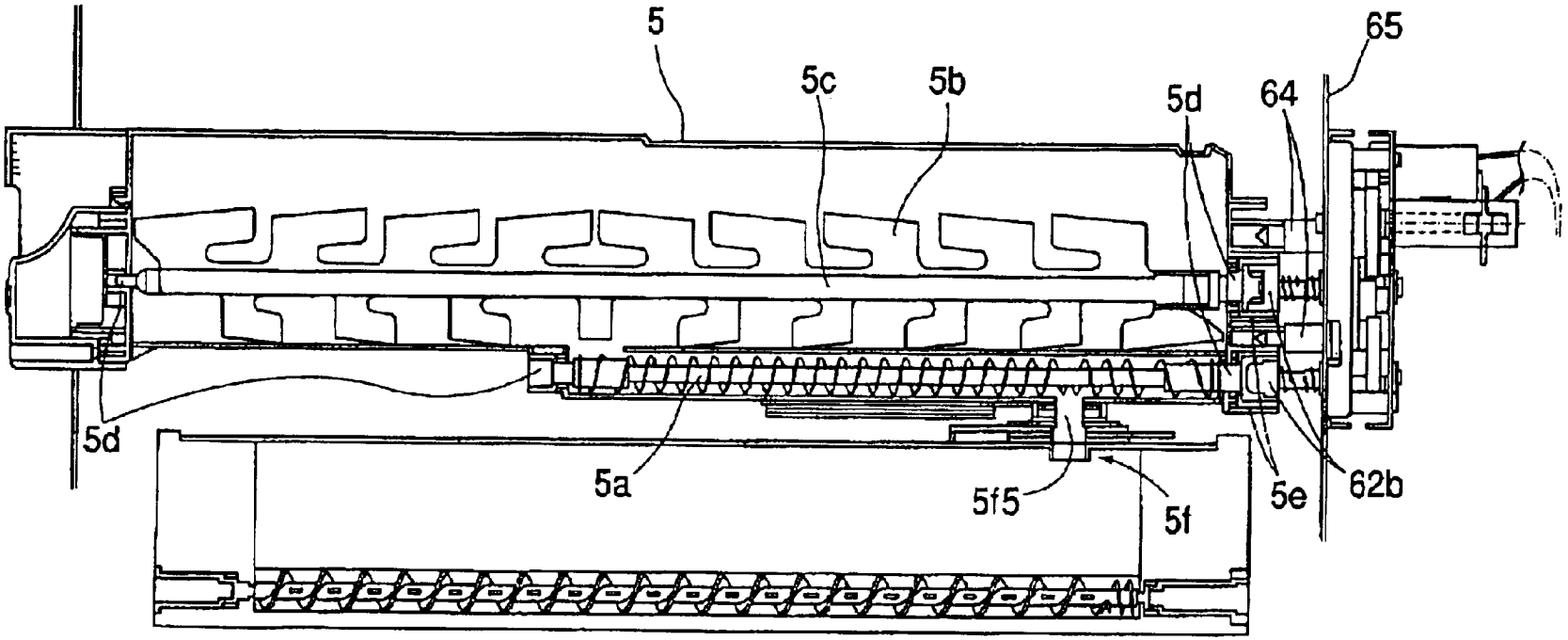
FIG. 5 is a vertical sectional view of the toner supply container in accordance with the present invention, at a plane parallel to the lengthwise direction of the container.

The toner supply containers 5Y, 5M, 5C, and 5K are parallelly disposed above the cartridges 1Y, 1M, 1C, and 1K, correspondingly. They are mounted into the apparatus main assembly 100 from the front side of the apparatus main assembly 100. Referring to FIG. 2, each toner supply container 5 holds toner or a mixture of toner and magnetic carrier, in its frame 5*g*, that is, the toner storage portion (developer storage portion). The toner supply container 5 is provided with a stirring shaft 5*c*, stirring plates 5*b* fixed to the stirring shaft 5*c*, and a screw 5*a*. It is also provided with an outlet 5*f*, which is at the bottom of the container 5, and by which it is connected to the cartridge 1. Referring to FIG. 5, the screw 5*a* and stirring shaft 5*c* are rotationally supported by bearings 5*d*, by their lengthwise ends, one for one. At the rear end (right end in FIG. 5), a coupling 5*e* (female type) is provided, which receives driving force from a coupling (male type) 62*b* on the apparatus main assembly 100 side, and is rotationally driven by the driving force. The screw 5*a* is rotated in a predetermined rotational direction by the rotation of the coupling (male type) 62*b*, and conveys the toner toward the outlet 5*f*, eventually causing the toner to free fall from the first opening 5*f*5 with which the outlet 5*f* is provided. Thus, the cartridge 1 is supplied with the toner.

[Transferring Means]

The intermediary transfer unit 54 as a transferring means is shown in FIG. 1. This unit 54 transfers (secondary transfer) all at once onto the recording medium 52, the plurality of toner images having been transferred (primary transfer) in layers onto a belt 54*a* from the photoconductive drum 2.

The intermediate transfer unit 54 is provided with the belt 54*a* which runs in the direction indicated by an arrow. The belt 54*a* runs in the direction of the arrow at approximately the same peripheral velocity as that of the photoconductive drum 2. It is an endless belt, and is stretched around three rollers: a driver roller 54*b*, a secondary transfer counter roller 54*g*, and a follower roller 54*c*.

Further, on the inward side of the loop of the belt 54*a*, transfer charge rollers 54*f*Y, 54*f*M, 54*f*C, and 54*f*K are rotationally disposed on the locations at which their peripheral surfaces oppose the peripheral surface of the photoconductive drum 2, being kept pressured toward the axial line of the photoconductive dram 2.

Each transfer charge roller is supplied with electrical power, by a high voltage power source (unshown), and charges the belt 54*a* to the polarity opposite to that of the toner, from the back side, that is, inward side of the belt 54*a*, with reference to the loop of the belt 54*a*. As a result, the toner images on the photoconductive drums 2 are transferred (primary transfer) onto the top surface of the belt 54*a*, one after another, in layers.

In the secondary transfer station, the secondary transfer roller 54*d* as a transferring member is disposed at the location which corresponds to the location of the roller 54*g*. During a transfer process, the secondary transfer roller 54*d* is kept pressed upon the belt 54*a* toward the roller 54*g*. The roller 54*d*, which is rotatable, is movable in the vertical direction in FIG. 1. In order to prevent the image or images on the belt 54*a* from being disturbed by the secondary transfer roller 54*d*, the secondary transfer roller 54*d* is kept away from the belt 54*a*, until a multicolor image is completed on the belt 54*a* by the sequential transfer of the monochromatic toner images onto the belt 54*a*.

The belt 54*a* and roller 54*d* are driven independently from each other. As the recording medium 52 enters the secondary transfer station, a predetermined bias is applied to the roller 54*d*. As a result, the monochromatic toner images on the belt 54*a* are transferred (secondary transfer) onto the recording medium 52.

After the completion of the transfer process, the recording medium 52 is conveyed in the leftward direction in FIG. 1 to a fixing device 56, in which the next process is carried out.

The apparatus main assembly 100 is provided with a cleaning unit 55 for removing the toner particles remaining on the belt 54*a* after the secondary transfer. The cleaning unit 55 is disposed at the location corresponding to a predetermined point of the loop of the bolt 54*a*, and is enabled to be placed in contact with, or moved my from, the surface of the bolt 54*a*.

Referring to FIG. 1, within the cleaning unit 55, a cleaning blade 55*a* for removing toner particles is disposed. The unit 55 is mounted so that it can be pivoted about a pivotal center (unshown). The blade 55*a* is kept pressed upon the belt 54*a*, being tilted so that the functional edge of the blade 55*a* is on the upstream side in terms of the rotational direction of the belt 54*a*, with respect to the base of the blade 55*a*. After being collected into the unit 55, the toner particles are conveyed by the screw 55*b* into a removed toner particle container (unshown) and are stored therein.

[Fixing Station]

As described above, after being formed on the photoconductive drum 2 by the developing means, the toner image is transferred onto the recording medium 52 by way of the belt 54*a*. Then, the fixing device 56 fixes the toner image on the recording medium 52, to the recording medium 52 with the use of heat and pressure.

Referring to FIG. 1, the fixing device 56 is provided with a fixing roller 56*a* and a pressure roller, for applying heat to the recording medium 52. Each roller contains a heater (unshown).

After the fixing, the recording medium 52 is discharged from the apparatus main assembly 100, by discharge rollers 53*h* and 53*j*, to be accumulated in a delivery tray 57 of the apparatus main assembly 100.

[Mounting of Process Cartridge and Toner Supply Container]

Figure 3:
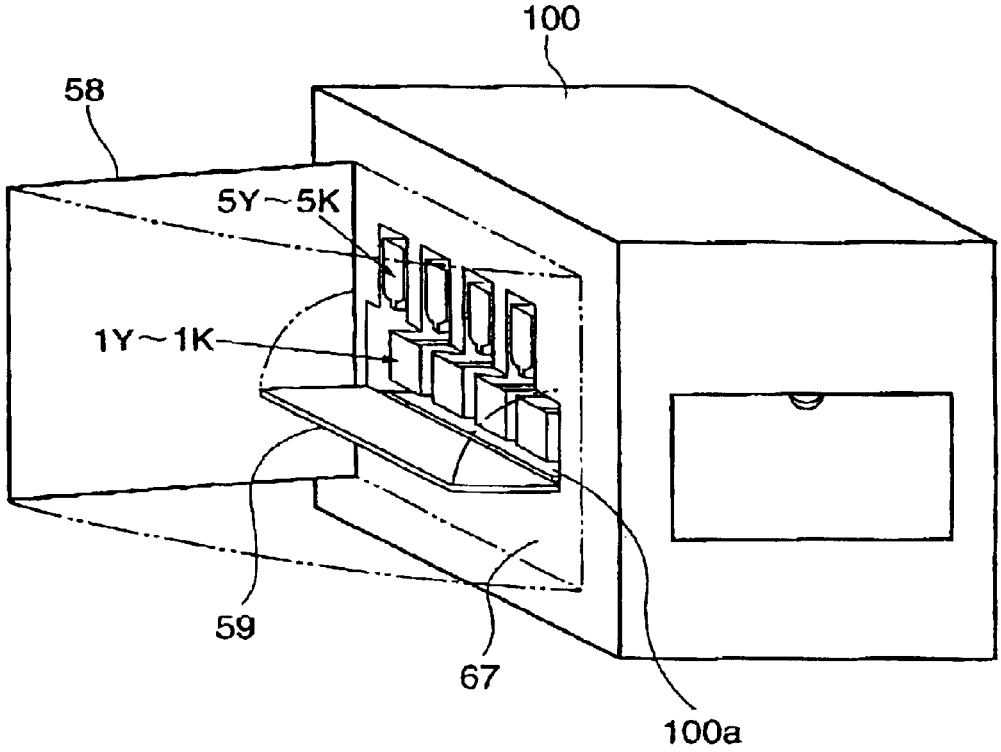
FIG. 3 is a perspective view of the image forming apparatus main assembly, with its front door being open, and shows the general appearance thereof.

Next, referring to FIGS. 2–5, the steps to be followed to mount the cartridge 1 and the toner supply container 5 into the apparatus main assembly 100 will be described. FIG. 3 is a schematic external perspective view of the apparatus main assembly 100. As shown in FIG. 3, the front wall of the apparatus main assembly 100 is provided with a front door 58 (opening/closing member) which can be opened or closed by an operator. As this door 58 is opened toward the front, the opening 100*a* is exposed, through which the cartridges 1Y–1K, and toner supply containers 5Y–5K, are inserted. The opening 100*a* is in the front plate (wall) 67 of the apparatus main assembly 100.

The apparatus main assembly 100 is also provided with a lid 59 (opening/closing member), which is rotatably attached to the bottom edge of the opening 100*a*. In order to mount or dismount the cartridge 1, this lid 59 must be first opened. Referring to FIG. 2, within the apparatus main assembly 100, a pair of guide rails 60 for guiding the mounting guides 1*a*1 of the cartridge 1, and a pair of guide rails 61 for guiding the mounting guides 5*g*1 of the toner supply container 5, are disposed. The mounting guides 1*a*1 are integral parts of the frame is of the cartridge 1, and are parallel to the axial line of the photoconductive drum 2.

In this embodiment, both the front door 58 and lid 59 are provided as members which can be opened or closed. However, provision of only one member, that is, either the front door 58 or lid 59, suffices.

The direction in which the cartridge 1 and toner supply container 5 are mounted into the apparatus main assembly 100 is parallel to the axial line of the photoconductive drum 2, and so are the directions in which the guide rails 60 and 61 are extended. The cartridge 1 and toner supply container 5 are inserted in the apparatus main assembly 100 from the front side of the apparatus main assembly 100, and are slid toward the rear side of the apparatus main assembly 100.

Referring to FIG. 4, as the cartridge 1 is inserted to the deepest end of the apparatus main assembly 100, the shaft 66 of the apparatus main assembly 100 fits into the center hole 2*f* of the drum flange 2*b*. At the same time, the driving force transmitting portion 2*g* becomes connected to the driving coupling (female type) 62*a*, enabling the photoconductive drum 2 to be rotationally driven.

Also referring to FIG. 4, the rear plate 65 of the apparatus main assembly 100 is provided with a cartridge supporting pin 63 for accurately positioning the cartridge 1 relative to the apparatus main assembly; the position of the cartridge 1 relative to the apparatus main assembly is fixed as the supporting pin 63 fits into the frame 1*a* of the cartridge 1.

Further, the lid 59 engages with the bearing case 2*c* of the cartridge 1, as shown in FIG. 4. As a result, the cartridge 1 becomes precisely supported in the predetermined position in the apparatus main assembly. Through the above described cartridge insertion sequence, the photoconductive drum 2 and cartridge 1 relative to the apparatus main assembly are precisely fixed in their positions relative to the apparatus main assembly As for the toner supply container 5, it is also inserted into the deep end of the apparatus main assembly 100 as is the cartridge 1, and is fixed to a supporting pin 64 projecting from the rear plate 65. At the same time, the coupling (female type) 5*e* becomes connected to the coupling (male type) 62*b*, enabling the screw 5*a* and stirring shaft 5*c* to be rotationally driven.

[Embodiments of Electrical Contacts]

Next, referring to FIGS. 6–11, the embodiments of the present invention will be described.

Figure 6:
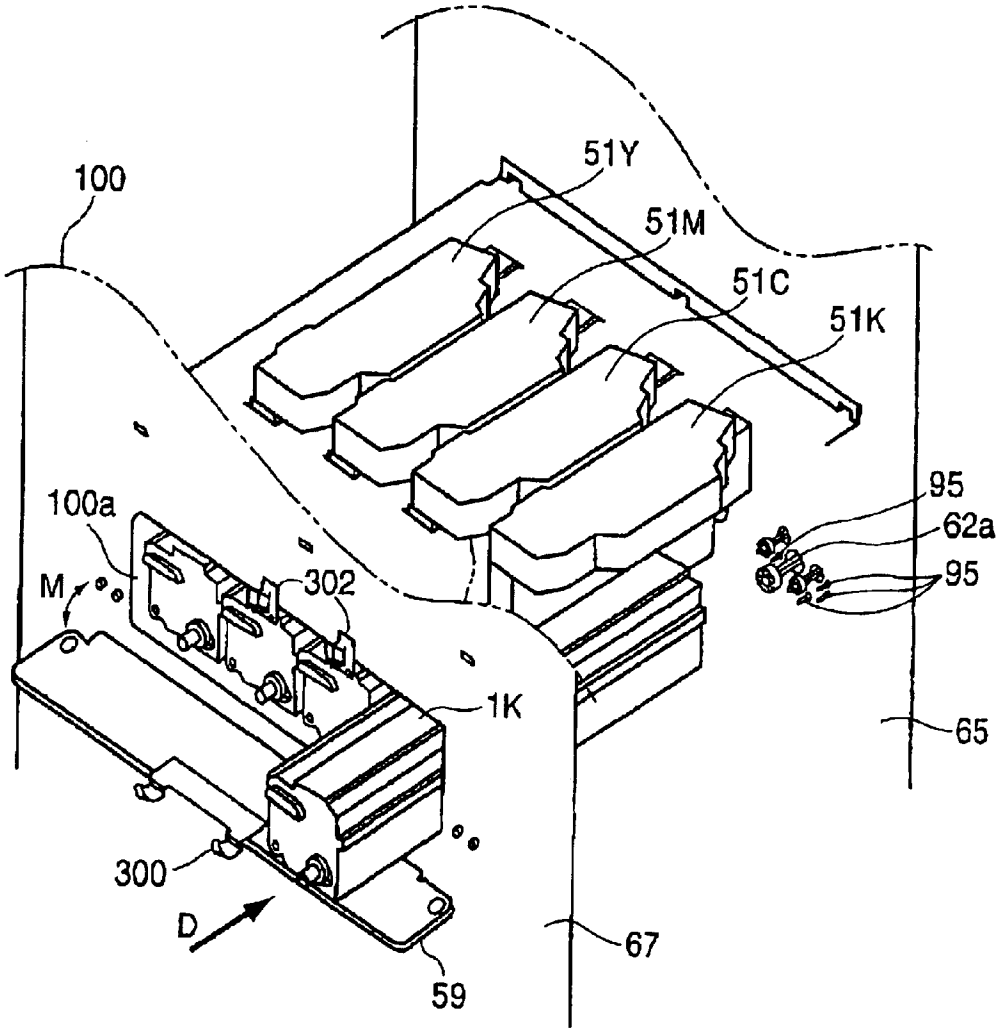
FIG. 6 is a partially cutaway perspective view of the main assembly of an electrophotographic image forming apparatus in accordance with the present invention, showing how the process cartridge in accordance with the present invention is inserted in the apparatus main assembly through the cartridge mounting/dismounting opening of the apparatus main assembly.

Referring to FIG. 6, in this embodiment, the cartridge 1 is mounted into the apparatus main assembly 100 in the front-to-rear direction (direction indicated by an arrow mark D).

As described previously, the apparatus main assembly 100 is provided with the opening 100*a* for mounting or dismounting the cartridge 1. The lid 59 (opening/closing member) for covering or exposing the opening 100*a* rotates about the rotational center 305 (FIG. 7) in the direction indicated by an arrow mark M, exposing or covering the opening 100*a*.

Further, the lid 59 is provided with a pair of latching claws 300, which are on the top edge of the lid 59, whereas the top edge of the opening 100*a* is provided with a pair of claw catches 302, the locations of which correspond to those of the latching claws 300. The claws 300 and claw catches 302 can be engaged with, or disengaged from, each other, in order to regulate the exposing or covering of the opening 100*a*. Generally, the lid 59 is opened or closed by an operator.

As described above, the apparatus main assembly 100 is provided with: the opening 100*a* for mounting the process cartridge into the apparatus main assembly 100, or dismounting it therefrom; the front door 58 enabled to assume the closed position in which it covers the opening 100*a*, and the open position into which it retreats to expose the opening 100*a*; and the lid 59 also enabled to assume the closed position in which it covers the opening 100*g*, and the open position into which it retreats to expose the opening 100*a*. The cartridge 1 is mounted or dismounted, when the front door 58 and lid 59 are assuming their open positions. The electrical contact pin 95 as the electrical contact on the apparatus main assembly 100 side is disposed in the deepest end of the cartridge mounting space in the apparatus main assembly 100, facing the opening 100*a*. The electrical contact pin 95 is in the form of a round rod, and is fixed to the apparatus main assembly 100.

Figure 8:
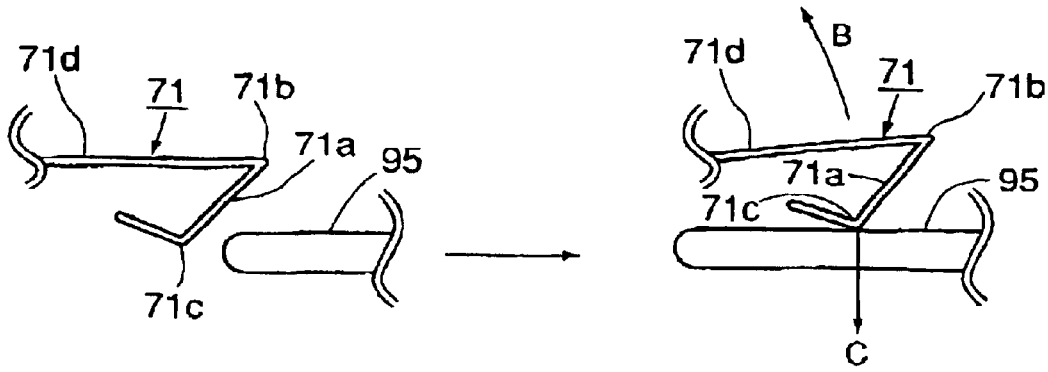
FIG. 8 is a schematic drawing for showing the concept of how an electrical connection is established between the high voltage contact of the process cartridge and the contact pin of the apparatus main assembly of the electrophotographic image forming apparatus, in one of the embodiments of the present invention.

Referring to FIG. 8, a contact 71 for supplying the electrical power necessary for the processing means in cartridge 1 to the cartridge 1 from the apparatus main assembly 100 is a leaf spring, and is shaped as shown in the drawings. The electrical contact 71 (electrical contact member on the process cartridge side) is bent at a corner 71*b*, and an inclined portion 71*a*, that is, the portion beyond the corner 71*b*, which is bent at a point close to the tip, forms the actual electrical contact portion 71*c*. The contact 71 is structured so that the actual contact portion 71*c* is kept pressed upon the electrical contact pin 95 (electrical contact member on the apparatus main assembly side) by the resiliency of the arm portion 71*d*. Incidentally, in this embodiment, the development roller 4*a*, charge roller 3*a*, and brush 3*h* receive voltage from the apparatus main assembly 100, independently from each other. Thus, the apparatus main assembly 100 is provided with three contacts 71, and accordingly, the cartridge 1 is provided with three electrical contact pins 95.

Figure 7:
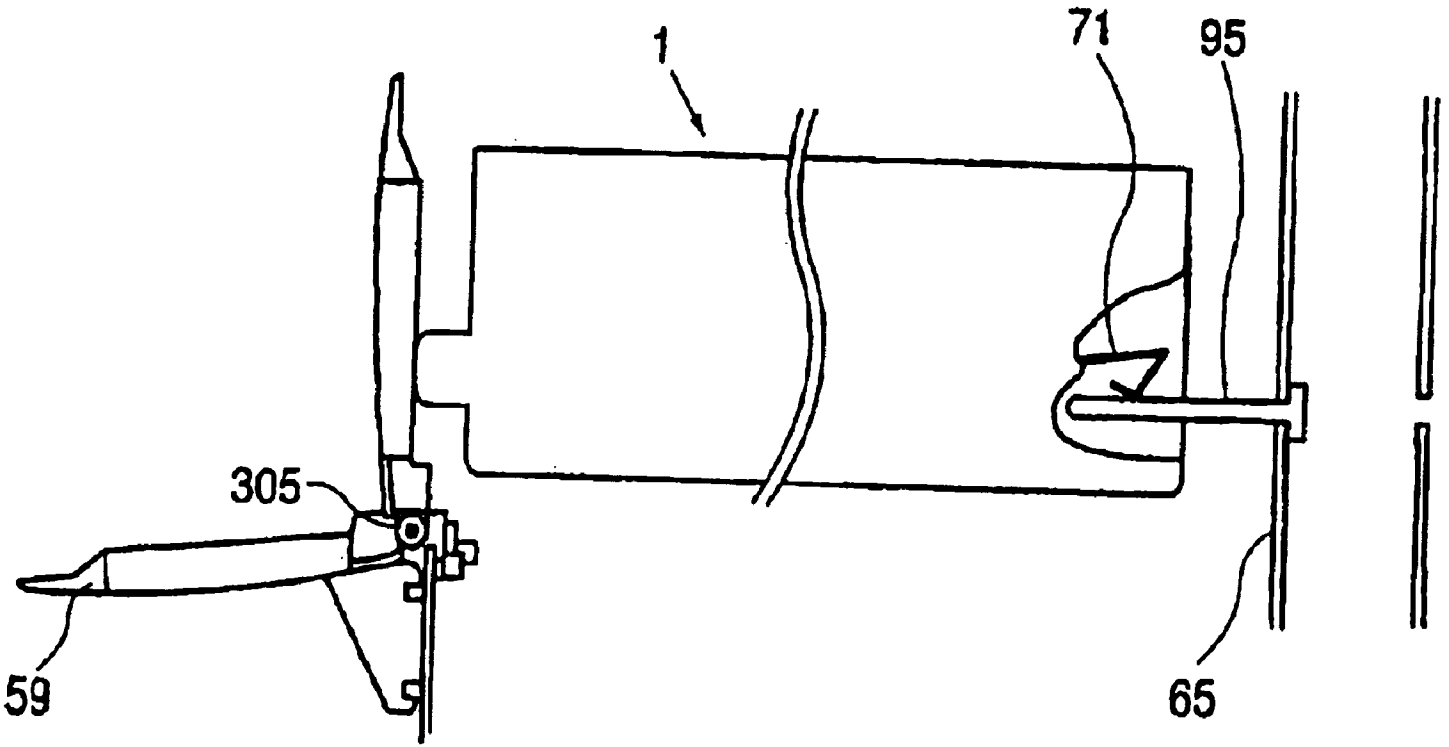
FIG. 7 is a schematic drawing for showing the concept of how an electrical connection is established between a process cartridge and the main assembly of an electrophotographic image forming apparatus, in accordance with the present invention.

Referring to FIGS. 6 and 7, the contact pin 95 which contacts the electrical contact 71 is located at the deepest end as seen from the opening 100*a* side. The contact pin 95 is fixed to the rear plate 65 of the apparatus main assembly 100, that is, the plate at the deepest end in terms of the process cartridge insertion direction, and projects toward the direction from which the process cartridge 1 is mounted into the apparatus main assembly 100, as shown in FIG. 7. The contact pin 95 is virtually parallel to the direction in which the cartridge 1 is mounted or dismounted. With the provision of the above described structural arrangement, the resistance (mounting load) to which the cartridge 1 is subjected during the mounting of the cartridge 1 is smaller, compared to the resistance in a prior structural arrangement. The contact pin 95 is electrically connected to the high voltage circuit board (unshown) provided in the apparatus main assembly 100. Thus, as the contact pin 95 comes into contact with the contact 71, it becomes possible for voltage to be supplied from the high voltage circuit board on the apparatus main assembly side to the cartridge 1.

Referring to FIG. 8, as the cartridge 1 is inserted into the apparatus main assembly 100, the inclined portion 71*a* of the contact 71 first comes into contact with the tip of the contact pin 95. Then, as the cartridge 1 is further inserted, the inclined portion 71*a* of the contact 71 is pushed up by the tip of the contact pin 95. As a result, the arm portion 71*d* is bent in the direction indicated by an arrow mark B. Since the contact 71 is formed of elastic material (in this embodiment, metallic material), a certain amount of reactive force is generated by the resiliency of the bent arm portion 71*d* in the direction indicated by an arrow mark C. The actual contact portion 71*c* is kept pressed upon 10 the contact pin 95 by this reactive force, generating the contact pressure necessary to keep the contact 71 and contact pin 95 electrically in contact with each other. While the actual contact portion 71*c* and contact pin 95 are kept in contact with each other by the resiliency of the arm portion 71*d*, the actual contact portion 71*c* is pressing upon the contact pin 95 in the direction virtually perpendicular to the direction in which the cartridge 1 is mounted or dismounted. In other words, the direction in which the actual contact portion 71*c* presses upon the contact pin 95 is different from the direction in which the cartridge 1 is mounted into the apparatus main assembly. Therefore, the cartridge 1 is not pushed back by the contact pressure, being allowed to be smoothly mounted into the apparatus main assembly 100.

Figure 13:
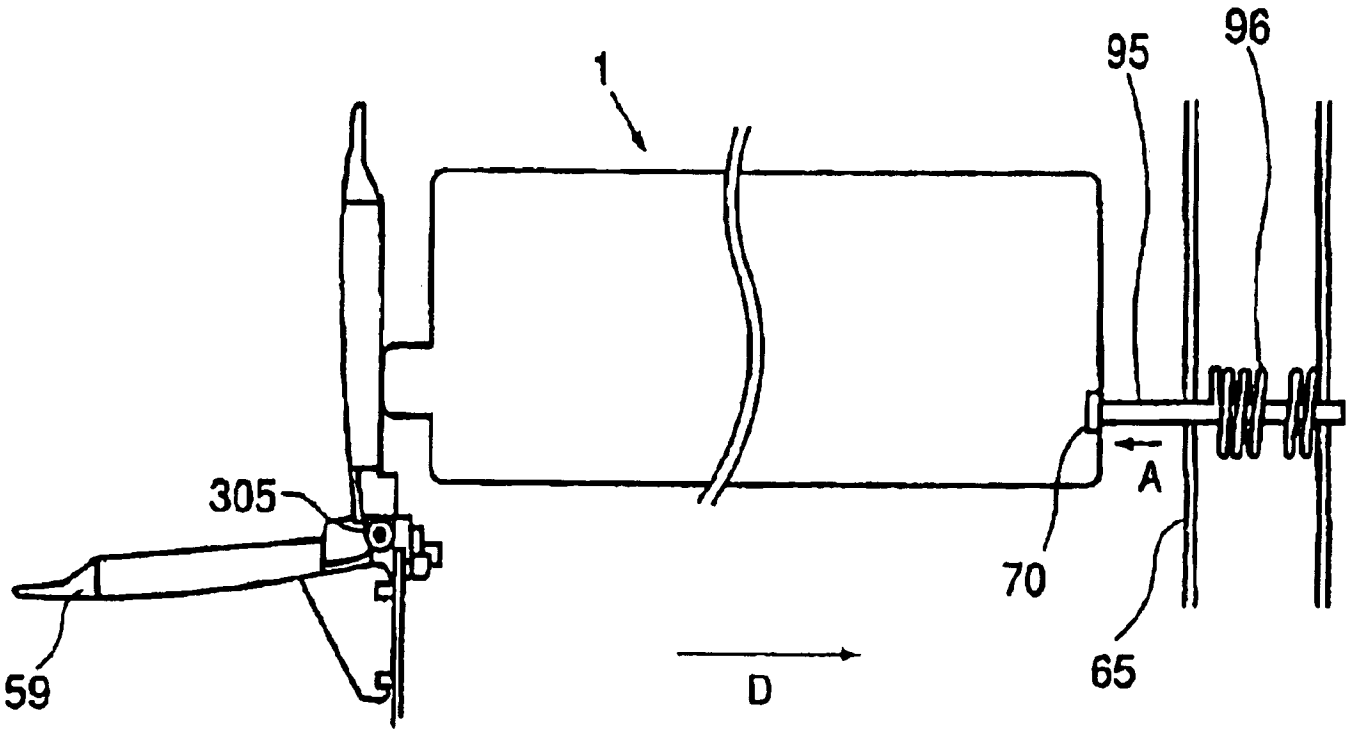
FIG. 13 is a schematic drawing for showing the concept of how the process cartridge shown in FIG. 7 is electrically connected to the main assembly of an electrophotographic image forming apparatus in accordance with the present invention.

After the mounting of the cartridge 1 into the apparatus main assembly 100, the opening 100*a* is covered by the rotating the lid 59 about the rotational center 305. During this closing of the lid 59, the cartridge 1 is not subjected to the pressure generated by the contact spring (FIG. 13) in the direction to push the cartridge 1 outward, as is the cartridge 1 in the case of a prior apparatus structure. Thus, the lid 59 can be closed by the application of a smaller force than the lid in a prior apparatus, making it easier for a user to operate the image forming apparatus. The lid 59 is rotated until the latching claws 300 engage with the claw catches 302. This concludes the mounting of the cartridge 1 into the apparatus main assembly 100.

In order to take the cartridge 1 out of the apparatus main assembly 100, first, the claws 300 are disengaged from the claw catches. Then, the lid 59 is rotated about the rotational center 305 to expose the opening 100*a*. Then, the cartridge 1 is pulled out of the cartridge 1 through the opening 100*a*. As a result, the actual contact portion 71*c* is separated from the contact pin 95, dissolving the electrical connection between the cartridge 1 and apparatus main assembly 100. As the cartridge 1 is pulled out of the apparatus main assembly 100, the arm portion 71*d* restores its original shape due to the resiliency of the material of the contact 71.

With the provision of the above described structural arrangement, the electrical connection between the contact 71 and contact pin 95 is automatically established as the cartridge 1 is mounted into the apparatus main assembly 100. In other words, it is assured, without requiring a user to carry out complicated operations, that electrical contact is established and maintained between the cartridge 1 and apparatus main assembly 100.

Further, the direction (indicated by the arrow mark C in FIG. 8) in which the actual contact portion 71*c* presses on the contact pin 95 is made different from the direction (indicated by the arrow mark D in FIG. 6) in which the cartridge 1 is mounted or dismounted Therefore, the cartridge 1 is not subjected to such force that acts in the direction to push the cartridge 1 outward of the apparatus main assembly 100, eliminating the need for requiring the lid 59 to counter the pressure which acts in the direction to move the cartridge 1 outward of the apparatus main assembly 100.

Figure 9:
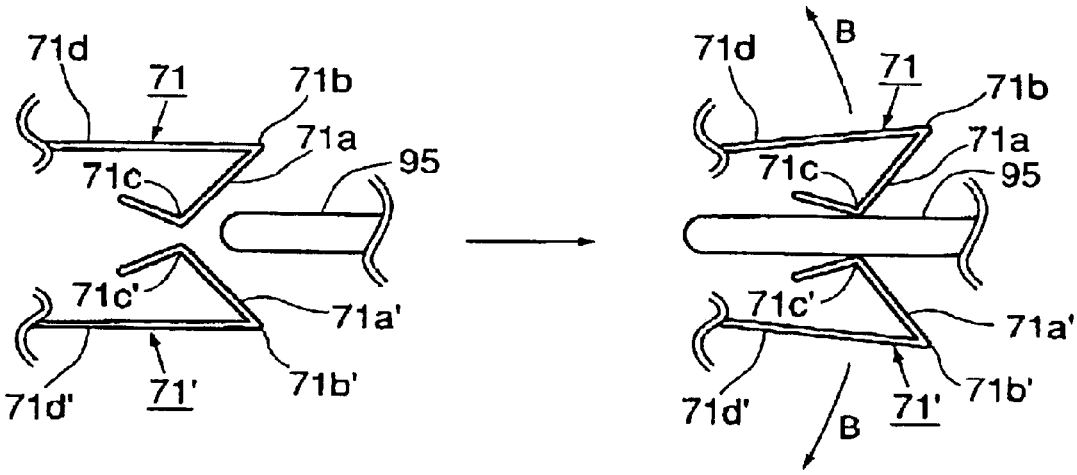
FIG. 9 is a schematic drawing for showing the concept of how an electrical connection is established between the high voltage contact of the process cartridge and the contact pin of the apparatus main assembly of the electrophotographic image forming apparatus, in another embodiment of the present invention.

As for another embodiment of the electrical contact, the cartridge 1 may be provided with two contacts 71 and 71', which are symmetrically disposed with respect to the axial line of the contact pin 95, as shown in FIG. 9. In such a case, the structure of the cartridge 1 itself, and the method for mounting or dismounting the cartridge 1, are the same as in the above described structure in which one contact 71 is provided. Here, therefore, only the structures of the two contacts 71 and 71' will be described. In this embodiment, the two contacts 71 and 71' are disposed so that their actual contact portions 71*c* and 71'*c* face each other. As the cartridge 1 is inserted through the opening 100*a*, the contacts 71 and 71' advance toward the contact pin 95, and the inclined portions 71*a* and 71'*a* of the contacts 71 and 71' come into contact with the contact pin 95.

As the cartridge 1 is further inserted, the contacts 71 and 71' are pushed, in a relative sense, by the contact pin 95 in the direction to widen the distance between the actual contact portions 71*c* and 71'*c*. As a result, the contact pin 95 is sandwiched by the actual contact portions 71*c* and 71'*c*. In this state, the pressures applied to the contact pin 95 from the top and bottom sides by the contacts 71 and 71', respectively, are equal in magnitude, and therefore, cancel each other. Therefore, the contact pin 95 is prevented from being subjected to only the force which acts thereupon in the downward direction, or only the force which acts thereupon in the upward direction.

The contact pressures and generated by the contacts 71 and 71' can be made to cancel each other, by disposing the two contacts 71 and 71' in a manner to oppose each other as described above. In other words, the pressures, which act upon the contact pin 95 in the direction virtually perpendicular to the direction in which the cartridge 1 is mounted or dismounted, can be eliminated.

At this time, referring to FIGS. 10 and 11, the structure of the electrical contact 71 as an electrical contact member will be described in detail.

Figure 10:
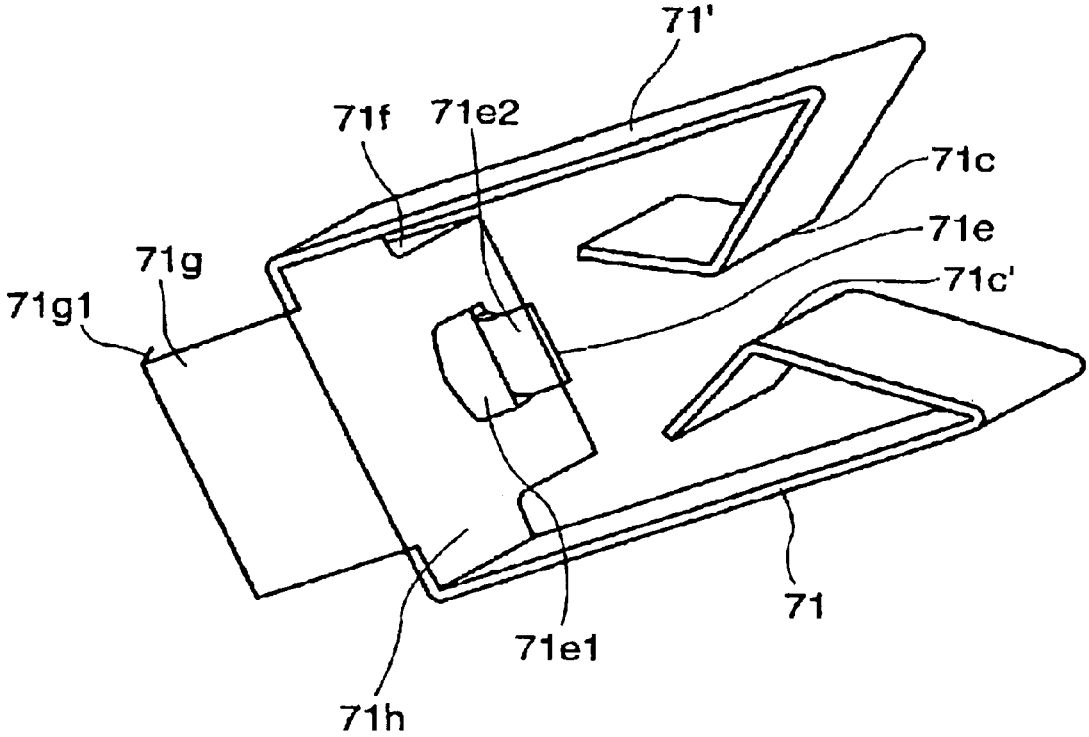
FIG. 10 is a perspective view of an electrical contact in accordance with the present invention.
Figure 11:
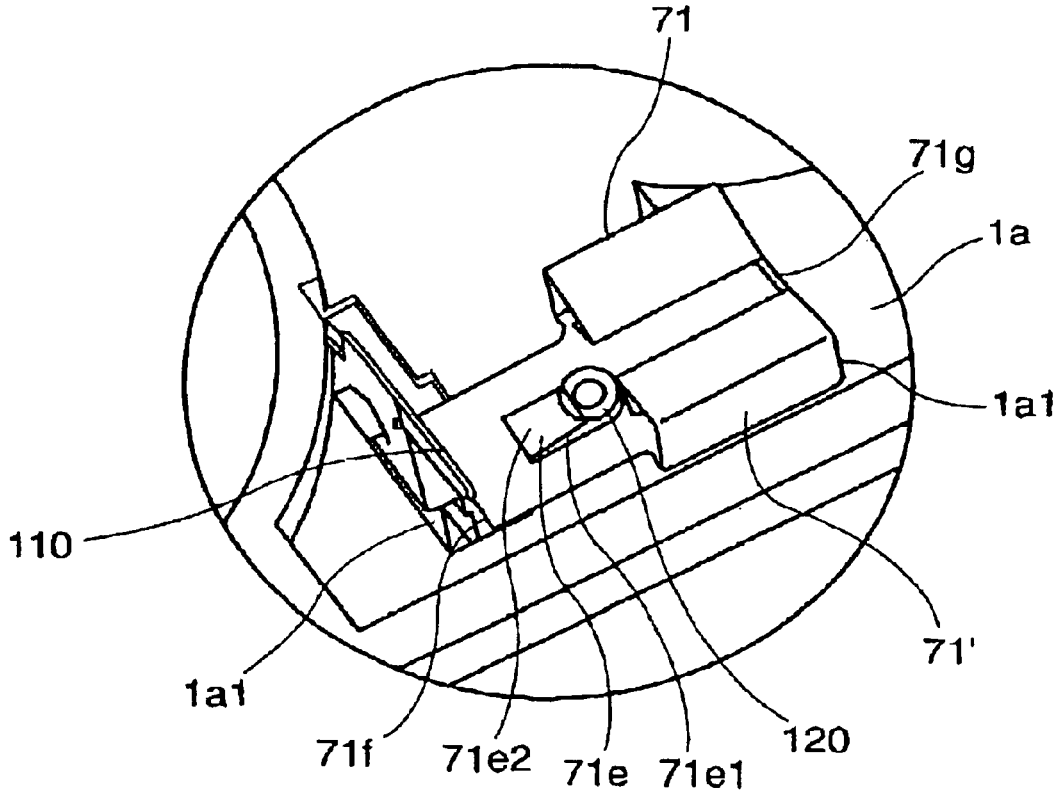
FIG. 11 is a perspective view of the electrical contact attached to the frame of a process cartridge in accordance with the present invention.
Figure 12:
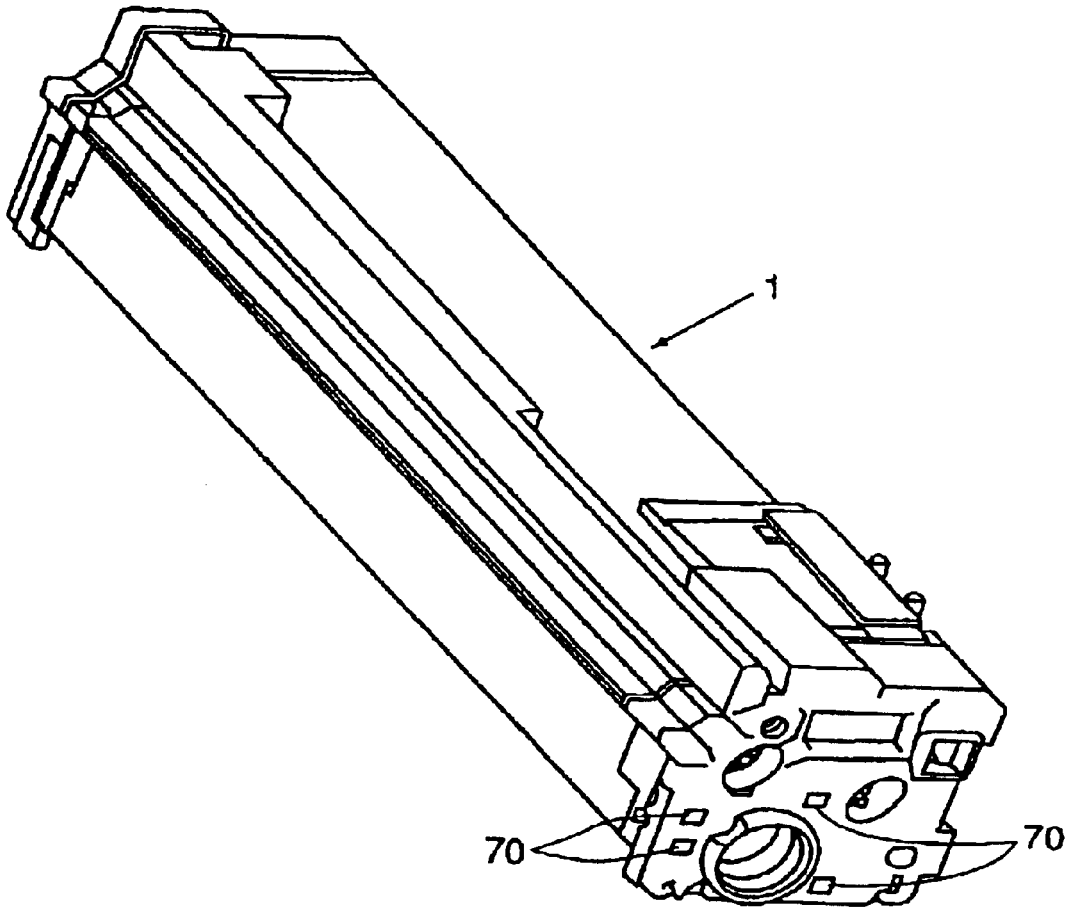
FIG. 12 is an external perspective view of the process cartridge developed during the process which led to the present invention.

FIG. 10 is a perspective view of the electrical contact 17, and FIG. 11 is a perspective view of the electrical contact 71 fixed to the cartridge frame 1*a*, and its adjacencies.

The electrical contact 71 (electrical contact member) in this embodiment is such an electrical contact that establishes electrical connection between the cartridge 1 and apparatus main assembly 100, as the cartridge 1 comprising the electrophotographic photoconductive drum 2, and the processing means which act upon the photoconductive drum 2, is mounted into the apparatus main assembly 100. The electrical contact 71 is used for the cartridge 1.

This contact 71 comprises: a base portion 71*h*, an anchoring portion 71*e*, a pair of positioning portions 71*f* and 71*g*, and a pair of electrical contact portions 71*c* and 71'*c*. The anchoring portion 71*e* is the portion by which the base portion 71*h* is fixed to the frame 1*a*. The pair of positioning portions 71*f* and 71*g* are for accurately positioning the base portion 71*h* relative to the frame 1*a*, when fixing the base portion 71*h* to the frame 1*a* by the anchoring portion 71*e*. The pair of electrical contact points 71*c* and 71'*c* project from the base portion 71*h*. They press on the electrical contact pin 95, that is, the electrical contact on the apparatus main assembly side, to establish and maintain electrical connection between themselves and the contact pin 95, as the cartridge 1, to which the electrical contact 71 has been fixed, is mounted into the apparatus main assembly 100. The direction in which they press on the electrical contact pin 95 is different from the direction in which the cartridge 1 is mounted into the apparatus main assembly 100.

The anchoring portion 71*e* is provided with a hole 71*e*1 through which a projection 120 of the frame 1*a* is put, and a pressing portion 71*e*2 which presses the projection 120, which has been put through the hole 71*e*1.

The pressing portion 71*e*2 is a part of the base portion 71*h*, which is formed by cutting base portion 71*h* along the edge of the pattern of the pressing member 71*e*2 drawn on the base portion 71*h*, and bending the portion surrounded by the cut edge, toward the electrical contact points 71*c* and 71'*c*, along the line connecting the two ends of the cut edge. The electrical contact 71 is formed of metallic substance. Thus, the pressing portion 71*e*2 is kept pressed upon the peripheral surface of the projection 120, by the resiliency of the metallic substance. Therefore, the contact 71 remains held to the frame 1*a* by the pressing portion 71*e*2. Incidentally, the contact 71 can be removed from the frame 1*a*, by applying force to the contact 71 in the direction to cause the projection 120 to come out of the hole 71*e*1. In other words, the contact 71 is removably attachable to the frame 1*a*.

The contact 71 is formed of metallic substance such as phosphor bronze, steel, stainless steel, or the like.

The positioning portions 71*f* and 71*g* project from the base portion 71*h* in the direction opposite to the direction in which the actual contact portions 71*c* and 71'*c* project from the base portion 71*h*. They are placed in contact with the edges of the frame holes 1*a*1 of the frame 1*a* to accurately position the electrical contact 71 relative to the frame 1*a*.

The tip of the positioning portion 71*g* is bent, and this bent portion 71*g*1 latches onto the frame 1*a*, securing the contact 71 to the frame 1*a*. At least one of the two positioning portions 71*f* and 71*g* is provided with such a tip portion.

The positioning portions 71*f* and 71*g* are on the opposing ends of the base portion 71*h*, one for one, in parallel to each other and perpendicular to the base portion 71*h*.

Further, when the electrical contact 71 is attached to the cartridge 1, the positioning portion 71*f* establishes electrical connection between itself and the electrical contact 110 in connection with one of the members of the cartridge 1, which require electrical power, by coming into contact with the member.

The members of the cartridge 1, which need to be supplied with electrical power, are the aforementioned processing means: development roller 4*a* for developing an electrostatic latent image formed on the photoconductive drum 2, charge roller 3*a* for charging the photoconductive drum 2, and auxiliary charge brush 3*h* for charging the photoconductive drum 2.

Referring to FIG. 7, the contact 71 is disposed within the external frame, that is, the external shell, of the cartridge frame. In other words, the contact 71 is placed so that it does not protrude from the external frame of the cartridge 1. With this structural arrangement, a user is prevented from coming into contact with the contact 71, when handing the cartridge 1. Therefore, it is assured that electrical contact is established and maintained between the cartridge 1 and apparatus main assembly 100. Although only one contact 71 is shown in FIG. 7, the basic arrangement regarding the provision of two contacts 71 is similar to the above described one.

In this embodiment, the contact 71, or the contact on the cartridge side, is an elastic member, and the contact pin 95, or the contact on the apparatus main assembly side, is a rigid member solidly fixed to the apparatus main assembly 100. However, the contact 71 and contact pin 95 may be reversed in placement and material, and the reversal will provide the same effects as those provided by the original placement and material.

As described above, according to the present invention, the electrical connection between the cartridge 1 and apparatus main assembly 100 can be established as the cartridge 1 is mounted into the apparatus main assembly 100. Therefore, it is possible to assure, without requiring a user to carry out complicated operations, that electrical connection is established and maintained between the cartridge 1 and apparatus main assembly 100.

Further, the direction of the contact pressure between the contact on the cartridge side and the contact on the apparatus main assembly side is virtually perpendicular to the direction in which the cartridge is mounted or dismounted.

Therefore, the cartridge is not subjected to such force that acts in the direction to push the cartridge out of the apparatus main assembly 100. Thus, it is unnecessary to substantially strengthen the lid itself, and the portion of the apparatus main assembly which rotationally supports the lid.

Further, when a user opens or closes the lid, it is unnecessary for the use to overcome the contact pressure. Therefore, the operability of the image forming apparatus in terms of the cartridge mounting efficiency is better.

The present invention could improve the operability of an image forming apparatus in terms of the efficiency with which a process cartridge is mounted into the main assembly of the image forming apparatus.

While the invention has been described with reference to the structures disclosed herein, it is not confined to the details set forth, and this application is intended to cover such modifications or changes as may come within the purposes of the improvements or the scope of the following claims.

What is claimed is:

1. An electrical contact member, usable with a process cartridge, for establishing an electrical connection between the process cartridge and a main assembly of an electrophotographic image forming apparatus when the process cartridge is mounted to the main assembly of the electrophotographic image forming apparatus, the process cartridge including an electrophotographic photosensitive drum and process means actable on the electrophotographic photosensitive drum, said electrical contact member comprising:

a base member;

a mounting portion configured and positioned to mount said base member to a frame of the process cartridge;

a positioning portion configured and positioned to position said base member in the frame when said base member is mounted to the frame of the process cartridge by said mounting portion; and an electrical contact portion, projecting from said base member, configured and positioned to establish an electrical connection with a main assembly side electrical contact member, which is provided in the main assembly of the electrophotographic image forming apparatus, by pressing in a direction against the main assembly side electrical contact member when the process cartridge is mounted to the main assembly of the electrophotographic image forming apparatus, wherein said direction is different from a mounting direction in which the process cartridge is mounted to the main assembly of the electrophotographic image forming apparatus.

2. An electrical contact member according to claim 1, wherein said mounting portion is provided with a hole configured and positioned to be penetrated by a projection provided on the frame and a pressing portion configured and positioned to press against a portion of the projection penetrated through said hole.

3. An electrical contact member according to claim 2, wherein said pressing portion includes a cut-and-erected portion provided by cutting and erecting said base member, and wherein said electrical contact member is composed of metal, and said cut-and-erected portion presses against a peripheral surface of the projection by an elastic force of the metal.

4. An electrical contact member according to claim 1, wherein said positioning portion projects from said base member at a side opposite from a side from which said electrical contact portion projects, and contacts an inner surface of a frame hole formed in the frame to position said electrical contact member.

5. An electrical contact member according to claim 1 or 4, wherein said positioning portion is disposed opposed to said base member.

6. An electrical contact member according to claim 5, wherein at least a part of said positioning portion has a free end portion which is bent, and wherein said electrical contact member is mounted to the frame by said bent free end portion being locked with the frame.

7. An electrical contact member according to claim 1, wherein when said electrical contact member is mounted to the process cartridge, said positioning portion contacts an electric energy receiving contact which is electrically connected with an electric energy receiving member of the process cartridge to establish an electrical connection therebetween.

8. An electrical contact member according to claim 7, wherein the electric energy receiving member includes a developing roller as one of the process means for developing an electrostatic latent image formed on the electrophotographic photosensitive drum, a charging roller as one of the process means for electrically charging the electrophotographic photosensitive drum, and a charging assistance brush as one of the process means for electrically charging the electrophotographic photosensitive drum.

9. A process cartridge detachably mountable to a main assembly of an electrophotographic image forming apparatus, comprising:

an electrophotographic photosensitive drum;

process means actable on said electrophotographic photosensitive drum; and an electrical contact member configured and positioned to establish an electrical connection with a main assembly side electrical contact member, which is provided in the main assembly of the electrophotographic image forming apparatus, by pressing in a direction against the main assembly side electrical contact member when said process cartridge is mounted to the main assembly of the electrophotographic image forming apparatus, wherein said direction is different from a mounting direction in which said process cartridge is mounted to the main assembly of the electrophotographic image forming apparatus, wherein said electrical contact member includes:

a base member;

a mounting portion configured and positioned to mount the base member to a frame of said process cartridge;

a positioning portion configured and positioned to position said base member in the frame when said base member is mounted to the frame of said process cartridge by said mounting portion; and an electrical contact portion configured and positioned to press against the main assembly side electrical contact member to establish the electrical connection therewith by pressing in the direction against the main assembly side electrical contact member when said process cartridge is mounted to the main assembly of the electrophotographic image forming apparatus.

10. A process cartridge according to claim 9, wherein said mounting portion is provided with a hole configured and positioned to be penetrated by a projection provided on the frame and a pressing portion configured and positioned to press against a portion of the projection penetrating through said hole, wherein said pressing portion includes a cut-and-erected portion provided by cutting and erecting said base member, and wherein said electrical contact member is composed of metal, and said cut-and-erected portion presses against a peripheral surface of the projection by an elastic force of the metal.

11. A process cartridge according to claim 10, wherein said process cartridge further comprises an electric energy receiving member, and wherein said positioning portion contacts an electric energy receiving contact which is electrically connected with said electric energy receiving member of said process cartridge to establish an electrical connection therebetween.

12. A process cartridge according to claim 11, wherein said electric energy receiving member includes a developing roller as one of said process means for developing an electrostatic latent image formed on said electrophotographic photosensitive drum, a charging roller as one of said process means for electrically charging said electrophotographic photosensitive drum, and a charging assistance brush as one of said process means for electrically charging said electrophotographic photosensitive drum.

13. A process cartridge according to claim 9, wherein said electrical contact portion projects from said base member, and wherein said positioning portion projects from said base member at a side opposite from a side from which said electrical contact portion projects, and contacts an inner surface of a frame hole formed in the frame to position said electrical contact member.

14. A process cartridge according to claim 9 or 13, wherein said positioning portion is disposed opposed to said base member.

15. A process cartridge according to claim 14, wherein at least a part of said positioning portion has a free end portion which is bent, and wherein said electrical contact member is mounted to the frame by said bent free end portion being locked with the frame.

16. An electrophotographic image forming apparatus, to which a process cartridge is detachably mountable, for forming an image on a recording material, comprising:

a main assembly side electrical contact member provided in a main assembly of said electrophotographic image forming apparatus; and a mounting portion configured and positioned to mount the process cartridge, the process cartridge including: process means actable on a photosensitive drum; and an electrical contact portion configured and positioned to establish an electrical connection with said main assembly side electrical contact member, by pressing in a direction against said main assembly side electrical contact member when the process cartridge is mounted to the main assembly of said electrophotographic image forming apparatus, wherein said direction is different from a mounting direction in which the process cartridge is mounted to the main assembly of said electrophotographic image forming apparatus, wherein said main assembly side electrical contact member is in the form of a circular column and is fixed to the main assembly of said electrophotographic image forming apparatus.

17. An apparatus according to claim 16, wherein the main assembly of said electrophotographic image forming apparatus comprises an opening configured and positioned to mount the process cartridge to the main assembly and demount it from the main assembly, and an openable member movable between a closing position for closing said opening and an opening position retracted from the closing position, wherein the process cartridge is mountable or demountable when said openable member is in the opening position, and said main assembly side electrical contact member is disposed opposed to said opening at a rear position of the main assembly.

18. A process cartridge detachably mountable to a main assembly of an electrophotographic image forming apparatus, said process cartridge comprising:

an electrophotographic photosensitive drum;

process means actable on said photosensitive drum;

a base member;

a mounting portion configured and positioned to mount said base member to a frame of said process cartridge;

a positioning portion configured and positioned to position said base member in the frame when said base member is mounted to the frame of said process cartridge by said mounting portion; and an electrical contact member having an electrical contact portion, projecting from said base member, configured and positioned to establish an electrical connection with a main assembly side electrical contact member, which is provided in the main assembly of the electrophotographic image forming apparatus, by pressing in a direction against the main assembly side electrical contact member when said process cartridge is mounted to the main assembly of the electrophotographic image forming apparatus, wherein said direction is different from a mounting direction in which said process cartridge is mounted to the main assembly of the electrophotographic image forming apparatus.

19. A process cartridge according to claim 18, wherein said mounting portion is provided with a hole configured and positioned to be penetrated by a projection provided on the frame and a pressing portion configured and positioned to press against a portion of the projection penetrating through said hole, and wherein said pressing portion includes a cut-and-erected portion provided by cutting and erecting said base member, and wherein said electrical contact member is composed of metal, and said cut-and-erected portion presses against a peripheral surface of the projection by an elastic force of the metal.

20. A process cartridge according to claim 18, wherein said positioning portion projects from said base member at a side opposite from a side from which said electrical contact portion is projected, and contacts an inner surface of a frame hole formed in the frame to position said electrical contact member.

21. A process cartridge according to claim 18 or 20, wherein said positioning portion is disposed opposed to said base member.

22. A process cartridge according to claim 21, wherein at least a part of said positioning portion has a free end portion which is bent, and wherein said electrical contact member is mounted to the frame by said bent free end portion being locked with the frame.

23. A process cartridge according to claim 18, wherein said positioning portion contacts an electric energy receiving contact which is electrically connected with an electric energy receiving member of said process cartridge to establish an electrical connection therebetween.

24. A process cartridge according to claim 23, wherein when said electrical contact member is mounted to said process cartridge, said positioning portion contacts the electric energy receiving contact which is electrically connected with the electric energy receiving member of said process cartridge to establish an electrical connection therebetween.

25. An electrical contact member, usable with a process cartridge, for establishing an electrical connection between the process cartridge and a main assembly of an electrophotographic image forming apparatus when the process cartridge is mounted to the main assembly of the electrophotographic image forming apparatus, the process cartridge including an electrophotographic photosensitive drum and process means actable on the electrophotographic photosensitive drum, said electrical contact member comprising:

a base member;

a mounting portion configured and positioned to mount said base member to a frame of the process cartridge;

a positioning portion configured and positioned to position said base member in the frame when said base member is mounted to the frame of the process cartridge by said mounting portion; and an electrical contact portion, projecting from said base member, configured and positioned to establish an electrical connection with a main assembly side electrical contact member, which is provided in the main assembly of the electrophotographic image forming apparatus, by pressing in a direction against the main assembly side electrical contact member when the process cartridge is mounted to the main assembly of the electrophotographic image forming apparatus, wherein said direction is different from a mounting direction in which the process cartridge is mounted to the main assembly of the electrophotographic image forming apparatus, wherein said mounting portion is provided with a hole configured and positioned to be penetrated by a projection provided on the frame and a pressing portion configured and positioned to press against a portion of the projection penetrated through said hole, wherein said pressing portion includes a cut-and-erected portion provided by cutting and erecting said base member, and wherein said electrical contact member is composed of metal, and said cut-and-erected portion presses against a peripheral surface of the projection by an elastic force of the metal, and wherein said positioning portion projects from said base member at a side opposite from a side from which said electrical contact portion projects, and contacts an inner surface of a frame hole formed in the frame to position said electrical contact member.

26. An electrical contact member according to claim 25, wherein said positioning portion is disposed opposed to said base member.

27. An electrical contact member according to claim 26, wherein at least a part of said positioning portion has a free end portion which is bent, and wherein said electrical contact member is mounted to the frame by said bent free end portion being locked with the frame.

28. An electrical contact member according to claim 25, 26 or 27, wherein when said electrical contact member is mounted to the process cartridge, said positioning portion contacts an electric energy receiving contact which is electrically connected with an electric energy receiving member of the process cartridge to establish an electrical connection therebetween.

29. An electrical contact member according to claim 28, wherein the electric energy receiving member includes a developing roller as one of the process means for developing an electrostatic latent image formed on the electrophotographic photosensitive drum, a charging roller as one of the process means for electrically charging the electrophotographic photosensitive drum, and a charging assistance brush as one of the process means for electrically charging the electrophotographic photosensitive drum.

30. A process cartridge detachably mountable to a main assembly of an electrophotographic image forming apparatus, comprising:

an electrophotographic photosensitive drum;

process means actable on said electrophotographic photosensitive drum; and an electrical contact member for establishing an electrical connection with a main assembly side electrical contact member, which is provided in the main assembly of the electrophotographic image forming apparatus, by pressing in a direction against the main assembly side electrical contact member when said process cartridge is mounted to the main assembly of the electrophotographic image forming apparatus, wherein said direction is different from a mounting direction in which said process cartridge is mounted to the main assembly of the electrophotographic image forming apparatus, wherein said electrical contact member includes:

a base member;

a mounting portion configured and positioned to mount the base member to a frame of said process cartridge;

a positioning portion configured and positioned to position said base member in the frame when said base member is mounted to the frame of said process cartridge by said mounting portion; and an electrical contact portion configured and positioned to press against the main assembly side electrical contact member to establish the electrical connection therewith by pressing in the direction against the main assembly side electrical contact member when said process cartridge is mounted to the main assembly of the electrophotographic image forming apparatus, wherein said mounting portion is provided with a hole configured and positioned to be penetrated by a projection provided on the frame and a pressing portion configured and positioned to press against a portion of the projection penetrating through said hole, wherein said pressing portion includes a cut-and-erected portion provided by cutting and erecting said base member, and wherein said electrical contact member is composed of metal, and said cut-and-erected portion presses against a peripheral surface of said projection by an elastic force of the metal, and wherein said electrical contact portion projects from said base member, and wherein said positioning portion projects from said base member at a side opposite from a side from which said electrical contact portion projects, and contacts an inner surface of a frame hole formed in the frame to position said electrical contact member.

31. A process cartridge according to claim 30, wherein said positioning portion is disposed opposed to said base member.

32. A process cartridge according to claim 31, wherein at least a part of said positioning portion has a free end portion which is bent, and wherein said electrical contact member is mounted to the frame by said bent free end portion being locked with the frame.

33. A process cartridge according to claim 30, 31 or 32, wherein said process cartridge further comprises an electric energy receiving member, and wherein said positioning portion contacts an electric energy receiving contact which is electrically connected with said electric energy receiving member of said process cartridge to establish an electrical connection therebetween.

34. A process cartridge according to claim 33, wherein said electric energy receiving member includes a developing roller as one of said process means for developing an electrostatic latent image formed on said electrophotographic photosensitive drum, a charging roller as one of said process means for electrically charging said electrophotographic photosensitive drum, and a charging assistance brush as one of said process means for electrically charging said electrophotographic photosensitive drum.

35. A process cartridge detachably mountable to a main assembly of an electrophotographic image forming apparatus, comprising:

an electrophotographic photosensitive drum;

process means actable on said electrophotographic photosensitive drum; and an electrical contact member configured and positioned to establish an electrical connection with a main assembly electrical contact, which is provided in the main assembly of the electrophotographic image forming apparatus so as to project in a direction against a mounting direction in which said process cartridge is mounted to the main assembly, by pressing against the main assembly electrical contact in a direction substantially perpendicular to the mounting direction when said process cartridge is mounted to the main assembly of the electrophotographic image forming apparatus.

36. An electrical contact member, usable with a process cartridge, for establishing an electrical connection between the process cartridge and a main assembly electrical contact member provided in a main assembly of an electrophotographic image forming apparatus to supply electrical power from the main assembly of the apparatus to process means provided in the process cartridge when the process cartridge is mounted to the main assembly of the apparatus, wherein the process means is actable on an electrophotographic photosensitive drum of the process cartridge, said electrical contact member comprising:

a plate-like member which includes:

a base portion;

an inclined surface portion provided by bending said base portion to produce a bent portion and further bending the bent portion; and a corner portion provided by bending a portion of said inclined surface portion toward said base portion, wherein when the process cartridge is inserted into the main assembly of the apparatus, said inclined surface portion is brought into abutment with the main assembly electrical contact member by which said plate-like member is elastically deformed, and said corner portion is urged to contact the main assembly electrical contact member by a reaction force provided by the elastic deformation.

37. An electrical contact member according to claim 36, in combination with another electrical contact member opposed to said electrical contact member in the process cartridge, wherein the process cartridge comprises said electrical contact member and said another electrical contact member, which are opposed to each other to sandwich in the main assembly electrical contact member.

38. An electrical contact member according to claim 35 or 36, wherein the process means includes a developing roller configured and positioned to develop an electrostatic latent image formed on the electrophotographic photosensitive drum, a charging roller configured and positioned to electrically charge the electrophotographic photosensitive drum, and a charging assistance brush configured and positioned to electrically charge the electrophotographic photosensitive drum.

39. A process cartridge detachably mountable to a main assembly of an electrophotographic image forming apparatus, comprising:

an electrophotographic photosensitive drum;

process means actable on said electrophotographic photosensitive drum; and an electrical contact member configured and positioned to establish an electrical connection between said process cartridge and a main assembly electrical contact member provided in the main assembly of the electrophotographic image forming apparatus to supply electrical power from the main assembly of the apparatus to said process means when said process cartridge is mounted to the main assembly of the apparatus, said electrical contact member comprising:

a plate-like member which includes:

a base portion;

an inclined surface portion provided by bending said base portion to produce a bent portion and further bending the bent portion; and a corner portion provided by bending a portion of said inclined surface portion toward said base portion, wherein when said process cartridge is inserted into the main assembly of the apparatus, said inclined surface portion is brought into abutment with the main assembly electrical contact member by which said plate-like member is elastically deformed, and said corner portion is urged to contact the main assembly electrical contact member by a reaction force provided by the elastic deformation.

40. A process cartridge according to claim 39, wherein said process cartridge comprises two of said electrical contact members, which are opposed to each other to sandwich in the main assembly electrical contact member.

41. A process cartridge according to claim 39 or 40, wherein said process means includes a developing roller configured and positioned to develop an electrostatic latent image formed on said electrophotographic photosensitive drum, a charging roller configured and positioned to electrically charge said electrophotographic photosensitive drum, and a charging assistance brush configured and positioned to electrically charge said electrophotographic photosensitive drum.

42. An electrophotographic image forming apparatus, to which a process cartridge is detachably mountable, for forming an image on a recording material, comprising:

a main assembly electrical contact member; and a mounting portion configured and positioned to mount the process cartridge, the process cartridge including:

an electrophotographic photosensitive drum;

process means actable on the electrophotographic photosensitive drum; and an electrical contact member configured and positioned to establish an electrical connection between the process cartridge and said main assembly electrical contact member to supply electrical power from the main assembly of said electrophotographic image forming apparatus to the process means when the process cartridge is mounted to a main assembly of said electrophotographic image forming apparatus, the electrical contact member comprising:

a plate-like member which includes:

a base portion;

an inclined surface portion provided by bending the base portion to produce a bent portion and further bending the bent portion; and a corner portion provided by bending a portion of the inclined surface portion toward the base portion, wherein when the process cartridge is inserted into the main assembly of said electrophotographic image forming apparatus, the inclined surface portion is brought into abutment with said main assembly electrical contact member by which the plate-like member is elastically deformed, and the corner portion is urged to contact said main assembly electrical contact member by a reaction force provided by the elastic deformation.

* * * * *

UNITED STATES PATENT AND TRADEMARK OFFICE

CERTIFICATE OF CORRECTION

PATENT NO. : 6,898,391 B2
DATED : May 24, 2005
INVENTOR(S) : Atsushi Numagami et al.

It is certified that error appears in the above-identified patent and that said Letters Patent is hereby corrected as shown below:

Title page,
Item [30], Foreign Application Priority Data, "2000/378501" should read -- 2000-378501 --; and "2001/353129" should read -- 2001-353129 --.
Item [56], References Cited, FOREIGN PATENT DOCUMENTS, "63004253 A" should read -- 63-4253 A --.

Column 5,
Line 45, "stations" should read -- station, --.

Column 9,
Line 28, "wp" should read -- up --.

Column 10,
Line 49, "dram" should read -- drum --.

Signed and Sealed this

Eighth Day of November, 2005

JON W. DUDAS
*Director of the United States Patent and Trademark Office*